US008641000B1

(12) United States Patent
Eide

(10) Patent No.: US 8,641,000 B1
(45) Date of Patent: Feb. 4, 2014

(54) TILE HOLDER AND METHODS OF USE

(76) Inventor: Frances W. Eide, Denver, CO (US)

( * ) Notice: Subject to any disclaimer, the term of this patent is extended or adjusted under 35 U.S.C. 154(b) by 304 days.

(21) Appl. No.: 12/557,043

(22) Filed: Sep. 10, 2009

Related U.S. Application Data

(60) Provisional application No. 61/095,934, filed on Sep. 10, 2008, provisional application No. 61/095,937, filed on Sep. 10, 2008.

(51) Int. Cl.

| | |
|---|---|
| ***F16M 11/00*** | (2006.01) |
| *A45D 19/04* | (2006.01) |
| *A47F 3/14* | (2006.01) |
| *A47B 43/00* | (2006.01) |
| *B65D 85/46* | (2006.01) |
| *A47G 1/16* | (2006.01) |

(52) U.S. Cl.
USPC ..... 248/176.1; 248/127; 211/133.4; 211/196; 206/322; 40/745

(58) Field of Classification Search
USPC ..... 211/133.1, 133.4, 189, 196, 123, 105.1, 211/16, 88.04, 41.1, 50, 41.13, 40; 248/200, 205.1, 220.21, 304, 127, 248/176.1, 158; 52/384, 385, 311.2, 311.3, 52/390; 40/745, 611.01; 206/322, 321; 294/187, 212
See application file for complete search history.

(56) References Cited

U.S. PATENT DOCUMENTS

| | | | | | |
|---|---|---|---|---|---|
| 1,423,226 | A * | 7/1922 | Kudner | 211/133.4 |
| 1,934,223 | A * | 11/1933 | Booth | 248/482 |
| 2,232,031 | A * | 2/1941 | Kavanagh | 131/238 |
| 2,557,434 | A * | 6/1951 | Hoverder | 248/544 |
| 3,187,449 | A * | 6/1965 | Longo et al. | 40/661.01 |
| 3,206,150 | A * | 9/1965 | Lang et al. | 248/158 |
| 3,384,987 | A * | 5/1968 | Prechtl | 40/757 |
| 4,310,976 | A * | 1/1982 | Wilten | 40/737 |
| 5,419,626 | A * | 5/1995 | Crockett | 312/7.2 |
| 5,743,140 | A * | 4/1998 | Gustafson | 74/6 |
| 5,799,914 | A * | 9/1998 | Chivallier et al. | 248/176.1 |
| 5,916,102 | A * | 6/1999 | Peyton | 52/385 |
| 5,987,794 | A * | 11/1999 | Lavi et al. | 40/611.04 |
| 6,010,017 | A * | 1/2000 | Michaelis et al. | 211/133.4 |
| 6,065,233 | A * | 5/2000 | Rink | 40/607.1 |
| 6,484,996 | B2 * | 11/2002 | Astell | 248/466 |
| 6,829,065 | B1 * | 12/2004 | Lee et al. | 358/474 |
| 7,002,640 | B2 * | 2/2006 | Jung | 348/787 |
| 7,566,035 | B2 * | 7/2009 | Bonshor | 248/205.1 |
| 2005/0195561 | A1 * | 9/2005 | Smith | 361/683 |
| 2006/0196965 | A1 * | 9/2006 | Christianson et al. | 239/60 |
| 2007/0084743 | A1 * | 4/2007 | Chu | 206/455 |
| 2007/0137081 | A1 * | 6/2007 | Chang | 40/781 |
| 2007/0234620 | A1 * | 10/2007 | Vineyard | 40/762 |

(Continued)

*Primary Examiner* — Joshua J Michener
*Assistant Examiner* — Devin Barnett
(74) *Attorney, Agent, or Firm* — Leyendecker & Lemire, LLC

(57) ABSTRACT

A tile holder and methods of its use are described. Embodiments of the tile holder are adapted to mounting to suitable objects and removably and replaceably receiving tiles and the like. Embodiments of the tile holder comprise a substantially rectangular parallelepiped shaped tile frame having a frame having a face plate having an aperture for exposing a face of the tile and the like, a back plate removably and releasably fastened to the frame and having a stud for mounting to a post having a receiving hole for receiving the stud of the back plate and locking the back plate to the post with a fastener, another fastener for fastening the post to a suitable object, and an optional escutcheon for optionally fastening the post to the escutcheon and the escutcheon to a wall or other suitable object.

4 Claims, 26 Drawing Sheets

(56) References Cited

U.S. PATENT DOCUMENTS

| | | | | |
|---|---|---|---|---|
| 2008/0110071 | A1* | 5/2008 | Farnsworth et al. | 40/722 |
| 2008/0120806 | A1* | 5/2008 | Liu | 16/277 |
| 2008/0129646 | A1* | 6/2008 | Bhavnani | 345/1.1 |
| 2009/0045305 | A1* | 2/2009 | Oshima et al. | 248/205.1 |
| 2009/0057510 | A1* | 3/2009 | Orban | 248/205.4 |
| 2009/0072678 | A1* | 3/2009 | Yokawa | 312/7.2 |
| 2010/0001146 | A1* | 1/2010 | Shimshon | 248/157 |
| 2010/0001151 | A1* | 1/2010 | Wheatley et al. | 248/206.2 |
| 2010/0012801 | A1* | 1/2010 | Gillespie | 248/220.21 |
| 2010/0012802 | A1* | 1/2010 | Bonshor | 248/220.21 |
| 2011/0101181 | A1* | 5/2011 | Jervey et al. | 248/205.1 |
| 2011/0138599 | A1* | 6/2011 | Bellacicco et al. | 29/428 |
| 2011/0139945 | A1* | 6/2011 | Fahrberger et al. | 248/121 |

* cited by examiner

TILE HOLDER AND METHODS OF USE

This application claims priority to, and incorporates by reference, U.S. provisional patent application Nos. 61/095,934 and 61/095,937, both of which were filed on 10 Sep. 2008. The aforementioned provisional applications both have the title "Tile Holder," and both have a common inventor with the present application.

FIELD OF THE INVENTION

The present invention relates generally to tile holders, and more particularly to tile holders for mounting tiles to walls and other objects.

BACKGROUND OF THE INVENTION

Tiles, decorative tiles, and the like are typically floor mounted and/or wall mounted to enhance interior and exterior appearance of homes and buildings throughout the world. The tiles, decorative tiles, and the like are typically permanently cemented onto the floors and/or walls.

There is a need, however, for the tiles, and, in particular, the decorative tiles to be removably and replaceably mounted to an object or objects and/or walls, and to be replaced from time to time, such as seasonally, by alternate tiles and/or decorative tiles, depending on the needs and desires of a user or users.

Many individuals, designers, and others need to accent various portions of their homes, offices, and/or properties with matching or even contrasting tiles and/or accents to stylize their homes and/or offices, and from time to time change those tiles. There is, thus, a need for a tile holder that may be used to removably and replaceably mount the tiles, decorative tiles, and the like to a variety of surfaces, objects, interior and exterior to homes, offices, buildings, and other suitable environments.

The tiles, decorative tiles, and the like should be capable of being removably and replaceably mounted to the walls and other objects, interior and exterior accessories, such as bathroom and kitchen accessories, doorknobs, handles, rods, curtain holders, towel holders, toilet tissue holders, cup holders, faucets, window curtain tie backs, dishes, and the like, in order to improve the appearance of such items and/or accessories and in many instances to improve the functionality of such items and/or accessories.

The tile holders should be durable, attractive, inexpensive, safe to use, sturdy, light weight, decorative, of simple construction, and capable of removably and replaceably holding a variety of different shaped tiles, such as, for example, square, rectangular, diamond, triangular, circular, elliptical, or other suitable shapes, and enhance the appearance of the tiles, decorative tiles, and the like.

Tiles, decorative tiles, and the like should be capable of being displayed and being installed, accessed, and removed, quickly, and easily. The tile holder should be capable of receiving a variety of tiles of different thicknesses. The tile holders should be capable of enabling a user or users to place and/or replace custom tiles in the tile holders that may have indicia and/or names of individuals, animals, pets, and/or suitable objects.

For the foregoing reasons, there is a need for a tile holder that may be mounted to a variety of objects, walls, and surfaces, and that may hold a variety of tiles, decorative tiles, and the like. The tiles, decorative tiles, and the like should be capable of being installed, accessed, and removably replaced from the tile holder from time to time quickly, easily, and efficiently.

The tile holder should be durable, attractive, inexpensive, safe to use, sturdy, light weight, decorative, of simple construction, and capable of removably and replaceably holding a variety of different shaped tiles, such as, for example, square, rectangular, diamond, triangular, circular, elliptical, or other suitable shapes. The tile holder should be capable of receiving a variety of tiles of different thicknesses.

SUMMARY

The present invention is directed to a tile holder for tiles, and, in particular, decorative tiles, and the like that may be removably and replaceably mounted to an object or objects and/or walls, and that may be replaced from time to time, such as seasonally, by alternate tiles and/or decorative tiles, depending on the needs and desires of a user or users.

The tile holder may be used by individuals, designers, and others who need to accent various portions of their homes, offices, and/or properties with matching or even contrasting tiles and/or accents to stylize their homes and/or offices, and from time to time change those tiles.

The tiles, decorative tiles, and the like are capable of being removably and replaceably mounted to a variety of surfaces, walls, and objects interior and exterior to homes, offices, buildings, and other suitable environments. The variety of surfaces, walls, and objects includes decorative or functional items such as, but not limited to, bathroom and kitchen accessories, doorknobs, handles, rods, curtain holders, towel holders, toilet tissue holders, cup holders, faucets, window curtain tie backs, dishes, and the like. Embodiments of tile holders improve the appearance of such items and/or accessories and in many instances improve the functionality of such items and/or accessories. The tile holders are durable, attractive, inexpensive, safe to use, sturdy, light weight, decorative, of simple construction, and are capable of removably and replaceably holding a variety of different shaped tiles, such as, for example, square, rectangular, diamond, triangular, circular, elliptical, or other suitable shapes, and enhance the appearance of the tiles, decorative tiles, and the like. The tile holder is capable of receiving a variety of tiles of different thicknesses.

The tile holder may be mounted to a variety of objects, walls, and surfaces, and may hold a variety of tiles, decorative tiles, and the like. The tiles, decorative tiles, and the like are capable of being displayed, installed, accessed, and removably replaced from the tile holder from time to time quickly, easily, and efficiently.

The tile holders enable a user to place and/or replace custom tiles in the tile holders that may have indicia and/or names of individuals, animals, pets, and/or suitable objects. The tile holder may be of metal, such as brass, copper, stainless steel, steel, or aluminum, thermoplastics, thermosetting polymers, rubber, or other suitable material or combination thereof. The tiles may be of ceramic, metal, stone, clay, glass, wood, resin, seashell, fabric, wallpaper, paper, or other suitable materials. The tile surfaces may be square, rectangular, diamond, triangular, polyhedral circular, elliptical, or other suitable shapes.

A tile holder for tiles and the like having features of the present invention comprises a substantially rectangular parallelepiped shaped tile frame having a face plate and an aperture. The aperture provides a view into a receptacle in which resides a tile; thus a face of the tile is visible in the receptacle, through the aperture. In some embodiments the tile holder further comprises a back plate removably and releasably fastened to the frame. Variations include a stud for mounting to a post having a receiving hole for receiving the stud, thereby enabling locking the back plate to the post with a fastener. In some embodiments, the tile holder comprises another fastener for fastening the post to a suitable object, and an optional escutcheon for optionally fastening the post to the escutcheon and the escutcheon to a wall or other suitable object.

DRAWINGS

These and other features, aspects, and advantages of the present invention will become better understood with regard to the following description, appended claims, and accompanying drawings where:

DETAILED DESCRIPTION

Terminology

Figure 1:
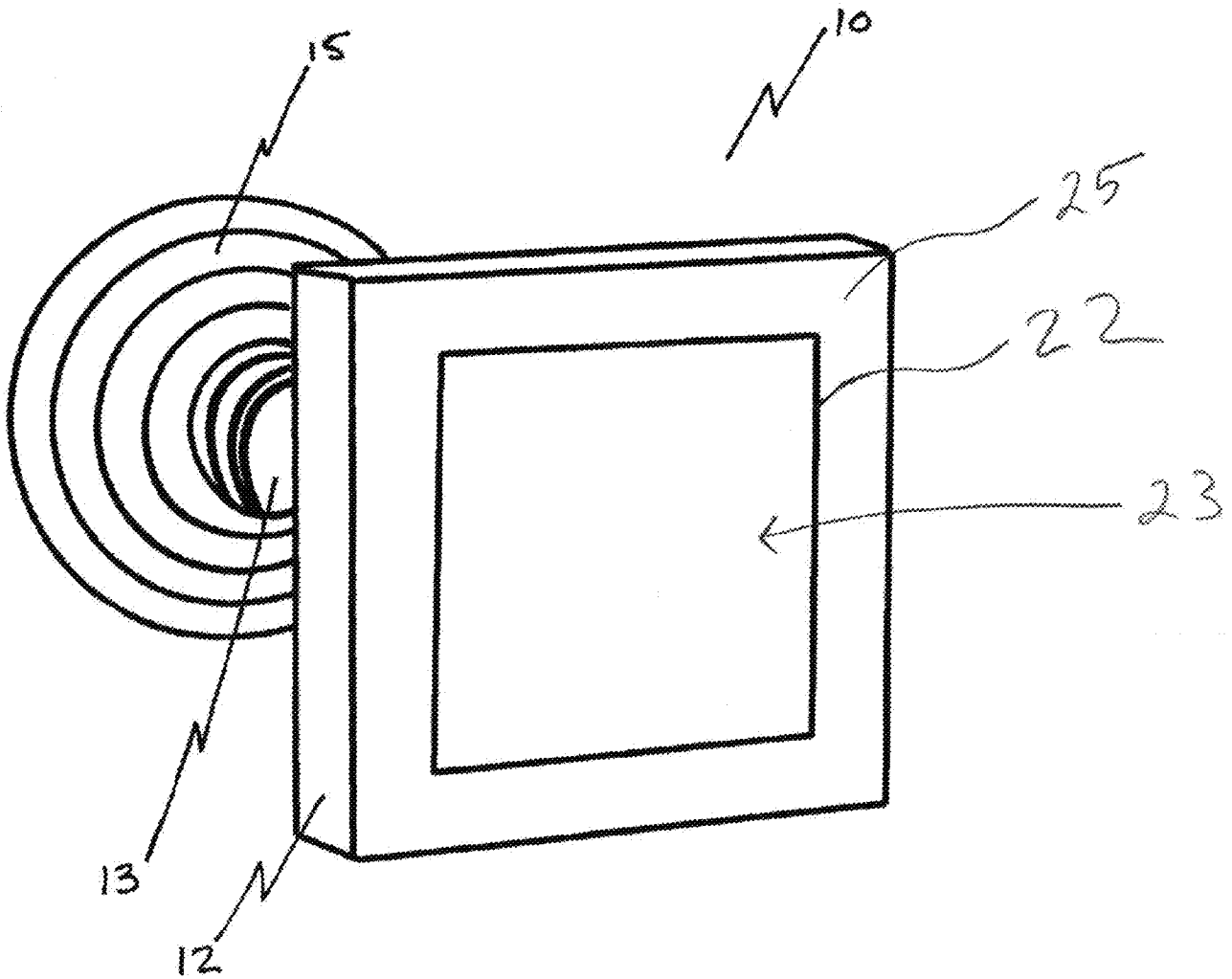
FIG. 1 is a front perspective view of a tile holder, constructed in accordance with the present invention.
Figure 3:
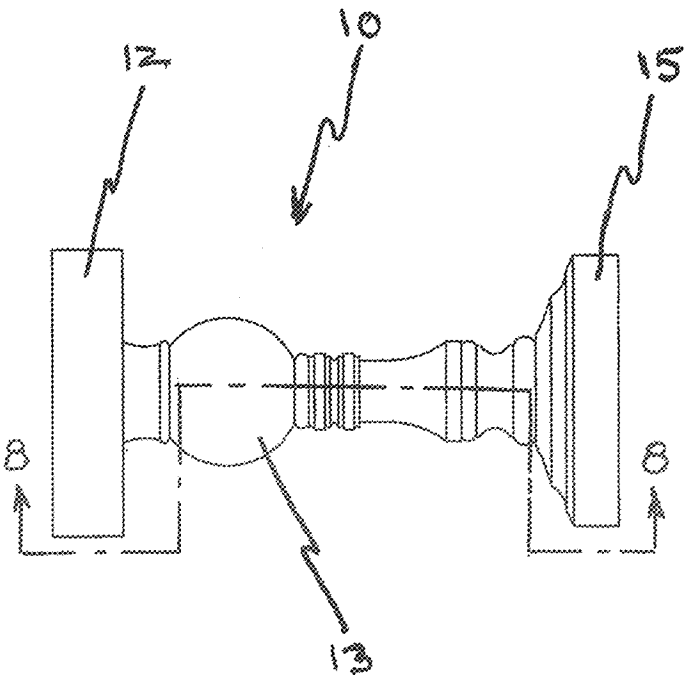
FIG. 3 is a side view of the tile holder of FIG. 1.
Figure 2:
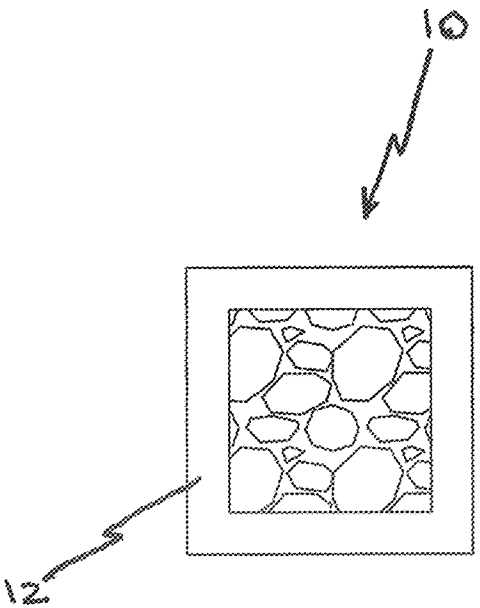
FIG. 2 is a front view of the tile holder of FIG. 1.
Figure 4:
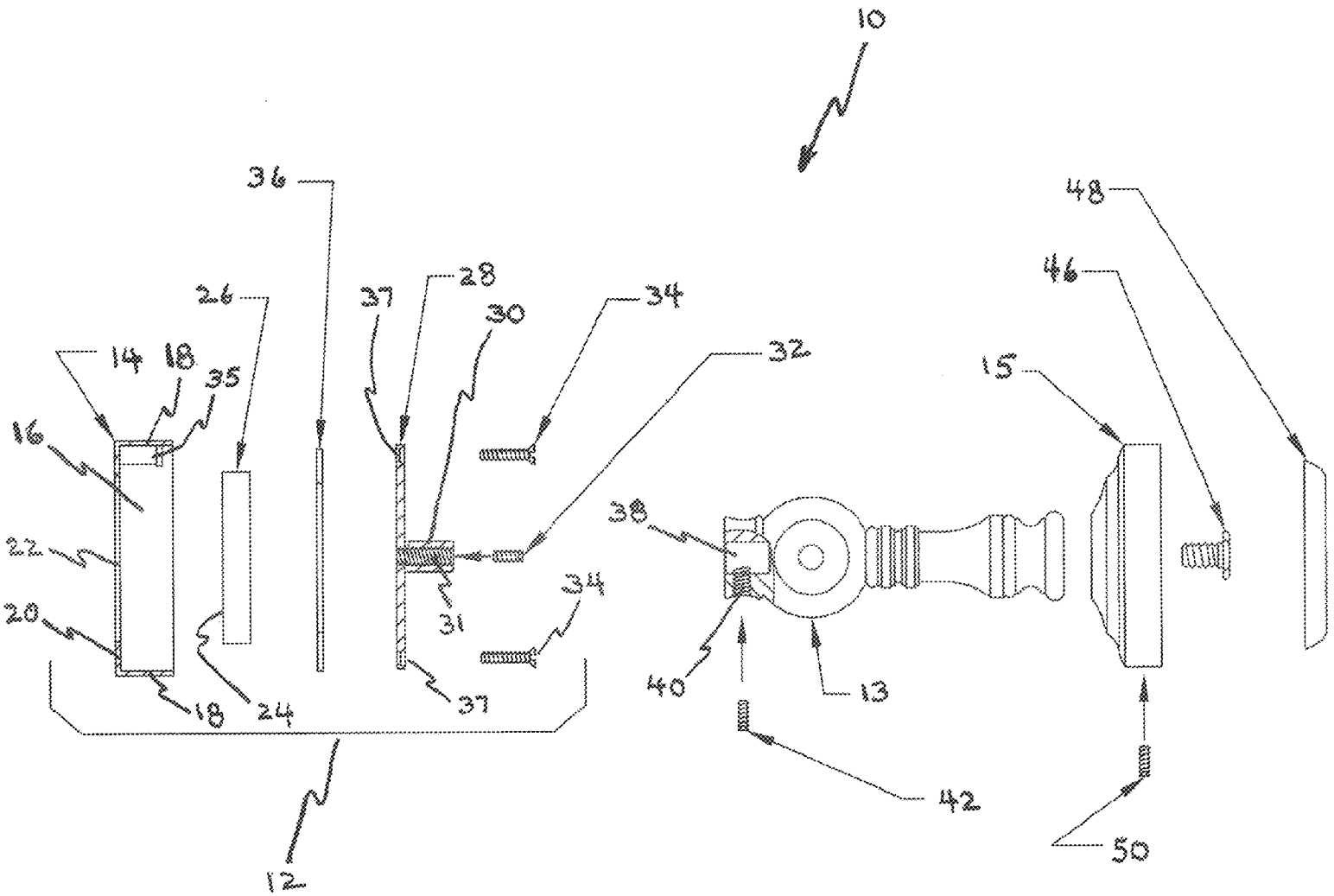
FIG. 4 is an exploded side view of the tile holder of FIG. 1.
Figure 7:
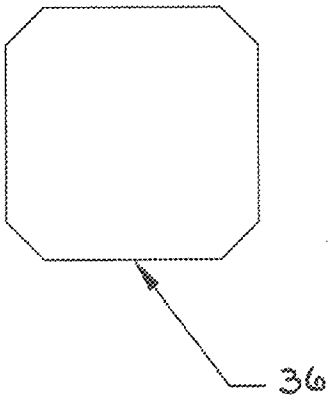
FIG. 7 is a front view of a spacer of the tile holder of FIG. 1.
Figure 6:
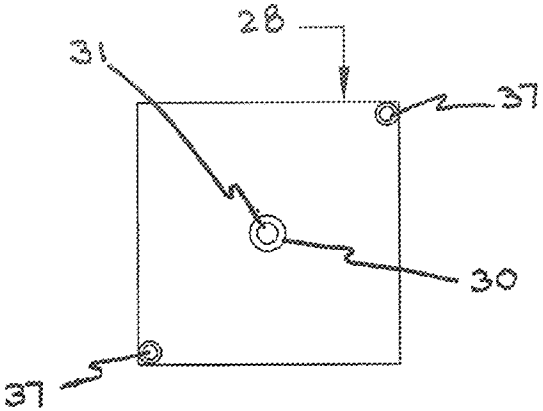
FIG. 6 is a rear view of a back plate of the tile holder of FIG. 1.
Figure 5:
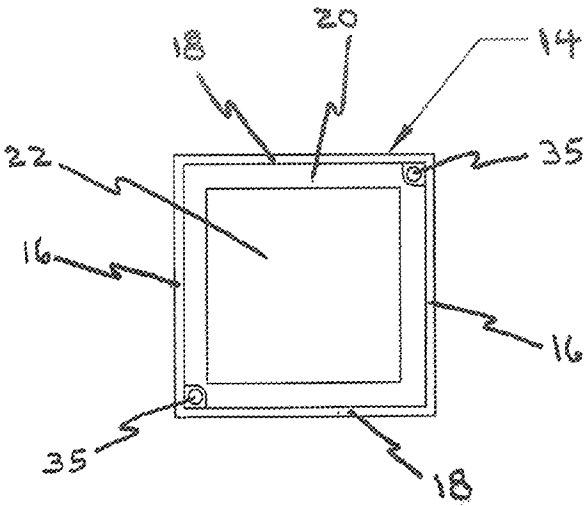
FIG. 5 is rear view of a frame of the tile holder of FIG. 1.
Figure 8:
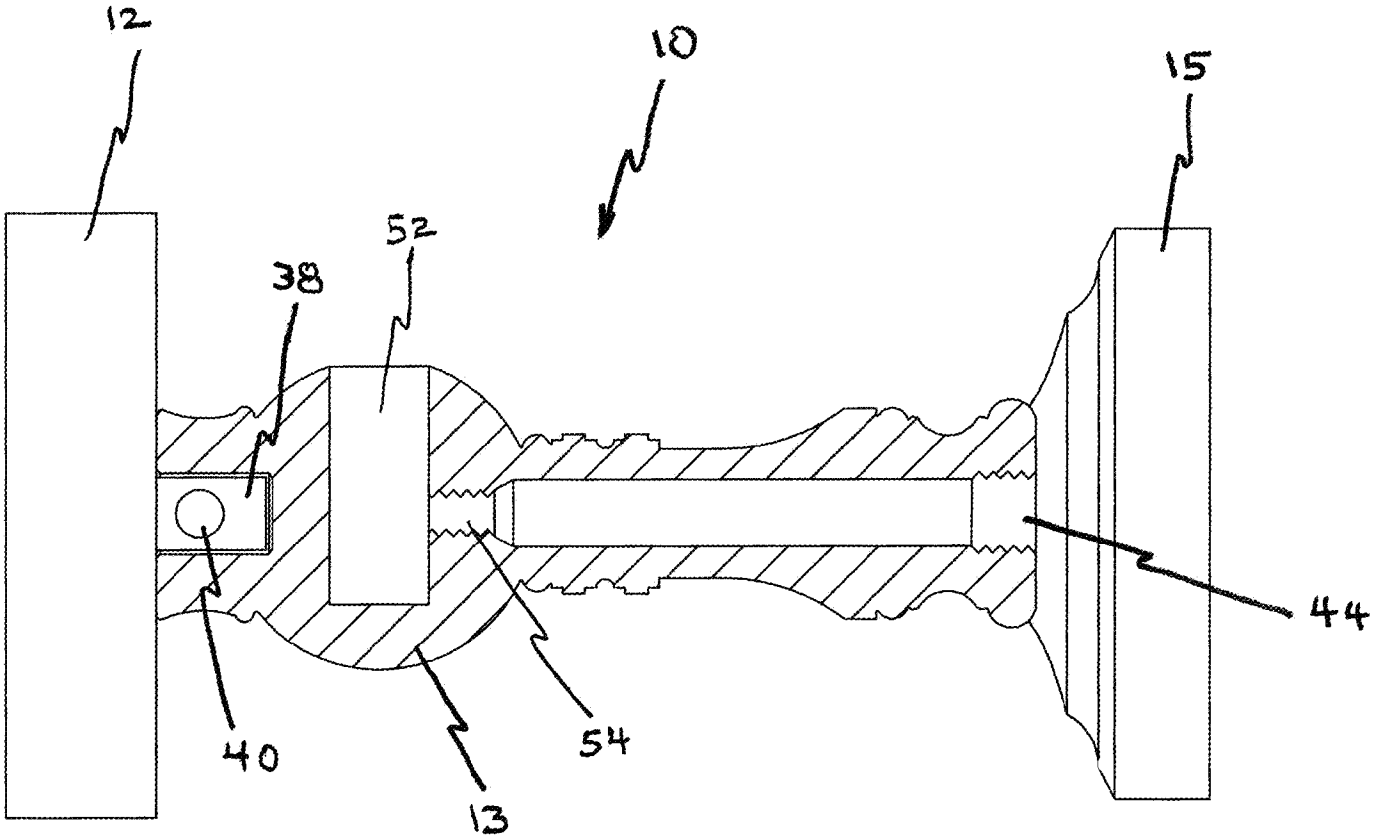
FIG. 8 is a side view of the tile holder of FIG. 1 showing a post of the tile holder as a section view.

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning “either or both.”

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

Embodiments of the Present Invention

Embodiments of the present invention are described with reference to FIGS. 1-37 of the drawings.

FIGS. 1-8 show an embodiment of the present invention, a tile holder 10 for tiles and the like having a substantially cuboid or substantially rectangular parallelepiped shaped tile frame 12, a post 13 for mounting the tile holder 10 to a suitable object, and an optional escutcheon plate 15 that may alternatively be used for mounting to a suitable object.

The tile frame 12 comprises frame 14 having substantially parallel opposing sides 16, substantially parallel opposing sides 18, which are substantially perpendicular to the substantially parallel opposing sides 18, face plate 20 having aperture 22 for exposing face 24 of tile 26, back plate 28 having stud 30 having threads 31 for receiving tile frame rear fastener 32, which is also threaded, threaded fasteners 34 for fastening the back plate 28 to the frame 14, and optional spacer 36 for maintaining the tile 26 in place within the receptacle 23, behind the tile frame 12. The tile frame 12 obstructs the tile 26 from falling out a front side 25 of the tile holder 10, a size of the tile 26 being greater than a size of the aperture 22. Adhesive is not required to hold the tile 26 within the receptacle 23. Through the aperture 22 a view is provided into the receptacle 23. The receptacle 23 comprises a cavity.

The face plate 20 and the back plate 28 oppose one another and are substantially parallel to one another, each of which are substantially perpendicular to the substantially parallel opposing sides 16 and the substantially parallel opposing sides 18. The tile frame rear fastener 32 may be used to releasably fasten the tile 26 behind the tile frame 12 within the receptacle 23, by fastening the tile frame rear fastener 32, thus, applying pressure to the optional spacer 36 and/or the tile 26, and, thus, holding the tile 26 within the receptacle.

The frame 14 has threaded holes 35 for removably receiving the threaded fasteners 34, and the back plate 28 has holes 37 for removably inserting the threaded fasteners 34 therethrough. The tile 26 may be removably replaced from the receptacle 23 of the tile holder 10 by removing the threaded fasteners 34 from the threaded holes 35 of the frame 14 through the holes 37 of the back plate 28, removing the back plate 28 from the frame 14, removing the tile 26 therefrom, replacing the tile 26 with an alternate tile, and fastening the back plate 28 to the frame 14 with the fasteners 34. Accordingly, the alternate tile resides in the receptacle 23 of the tile frame 10, and is visible through the aperture 22.

The post 13 has substantially cylindrical hole 38 for matingly receiving the stud 30, the outer surface of which is substantially cylindrically shaped. The post 13 also has threaded hole 40 for receiving set screw 42 for releasably locking and holding the stud in place, and, thus, releasably holding the tile frame 12 and the post 13 one to the other. The post 13 is adapted to fasten the tile holder 10 to walls, surfaces, and suitable objects. The post 13 has threaded hole 44 for receiving threaded fastener 46 and fastening the tile holder 10 to a suitable object, or another suitable fastener may be used. Alternatively, an optional wall mounting plate 48 may be mounted to a wall or other 10 suitable object, the post 13 may be fastened to the optional escutcheon plate 15 one to the other with the threaded fastener 46, and the optional escutcheon plate 15 may be fastened to the optional wall mounting plate 48 with optional set screw 50, or other suitable fasteners may be used for mounting the tile holder 10 to the optional wall mounting plate 48, which has been mounted to the wall or other suitable object.

The post 13 may have optional hole 52 for receiving a portion of another suitable object or accessory for mounting the other suitable object or accessory to the post 13 one to the other. The post 13 may also have threaded hole 54 for receiving an optional set screw and releasably locking the other suitable object or accessory to the post 13. The post 13 is a decorative post; however, a substantially cylindrical post or another suitable post may be used.

The tile holder 10 may be of metal, such as brass, copper, stainless steel, steel, or aluminum, thermoplastics, thermosetting polymers, rubber, or other suitable material or combination thereof. The tile 26 may be of ceramic, metal, stone, clay, glass, wood, resin, seashell, fabric, wallpaper, paper, or other suitable materials. The tile surfaces may be square, rectangular, diamond, triangular, circular, elliptical, or other suitable shapes.

Figure 9:
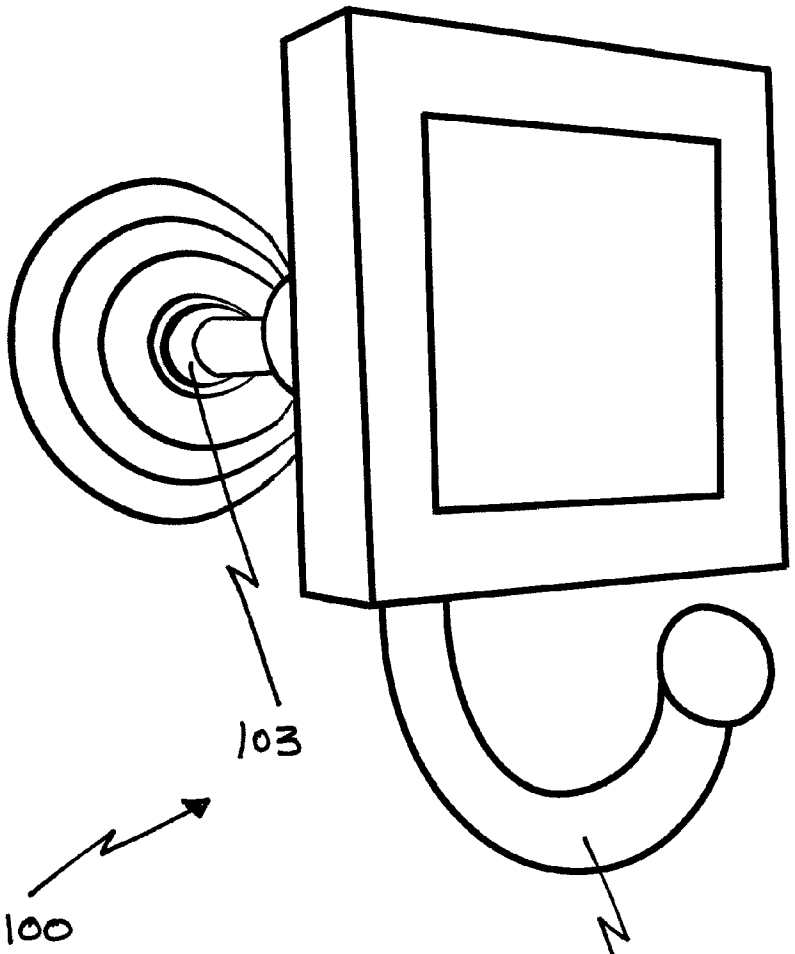
FIG. 9 is a front perspective view of an alternate embodiment of a tile holder, constructed in accordance with the present invention.
Figure 11:
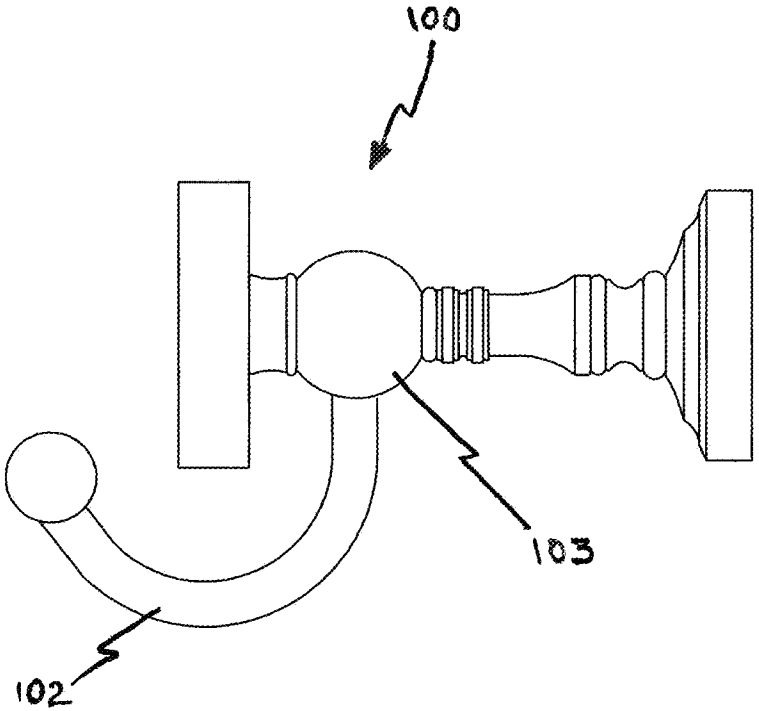
FIG. 11 is a side view of the alternate embodiment of the tile holder of FIG. 9.
Figure 10:
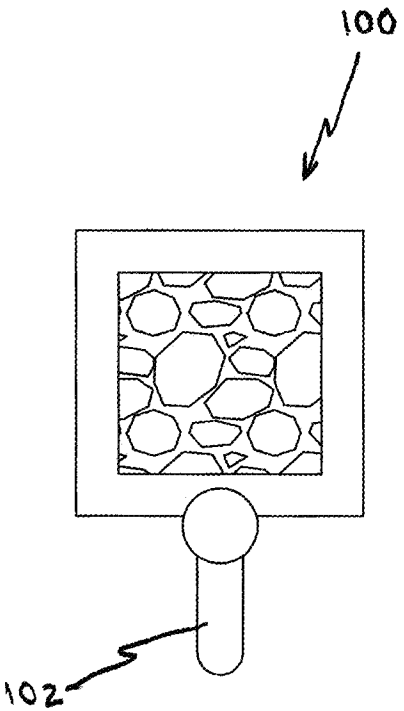
FIG. 10 is a front view of the alternate embodiment of the tile holder of FIG. 9.

FIGS. 9-11 show an alternate embodiment of a tile holder 100 of the present invention, which is substantially the same as the tile holder 10, except that the tile holder 100 has a hook 102 fastened to post 103 of the tile holder 100. The hook 102 may be used to hang towels or other suitable items therefrom or may be used as a drapery tieback.

Figure 12:
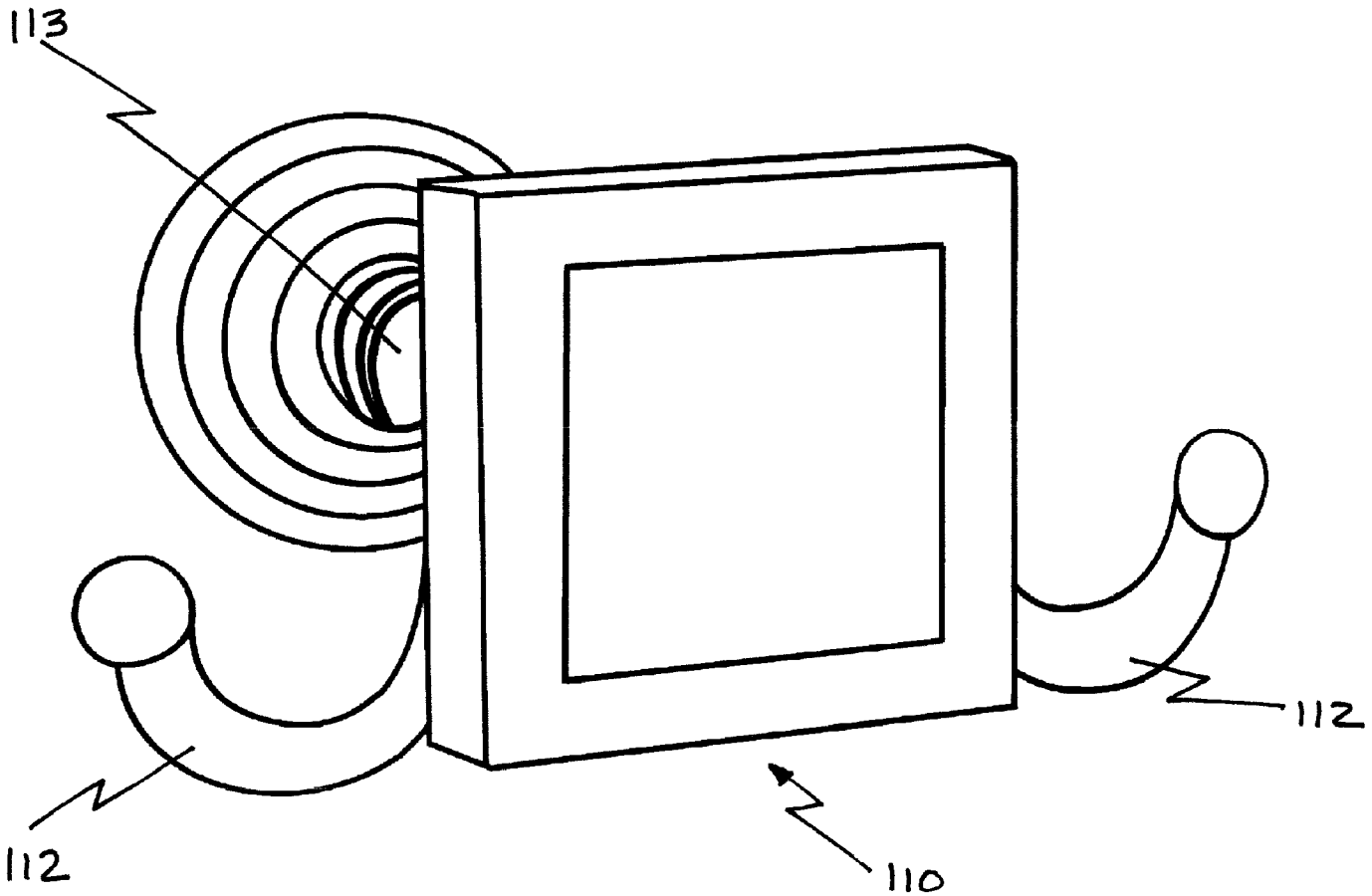
FIG. 12 is a front perspective view of an alternate embodiment of a tile holder, constructed in accordance with the present invention.
Figure 14:
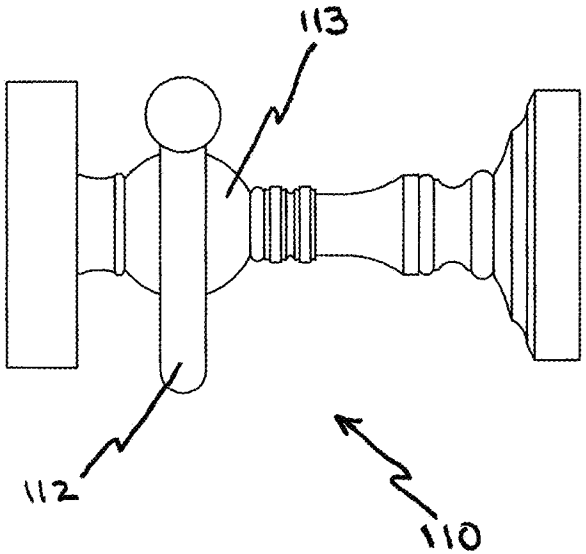
FIG. 14 is a side view of the alternate embodiment of the tile holder of FIG. 12.
Figure 13:
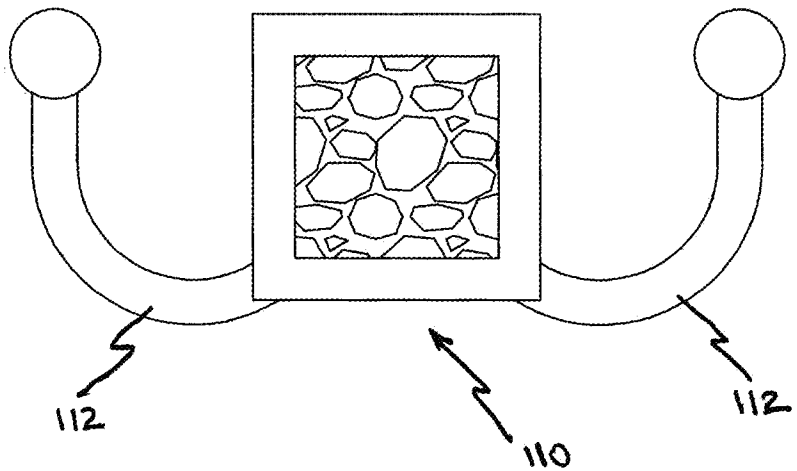
FIG. 13 is a front view of the alternate embodiment of the tile holder of FIG. 12.

FIGS. 12-14 show an alternate embodiment of a tile holder 110 of the present invention, which is substantially the same as the tile holder 10, except that the tile holder 110 has opposing hooks 112 fastened to post 113 of the tile holder 110. The opposing hooks 112 may be used to hang towels or other suitable items therefrom.

Figure 15:
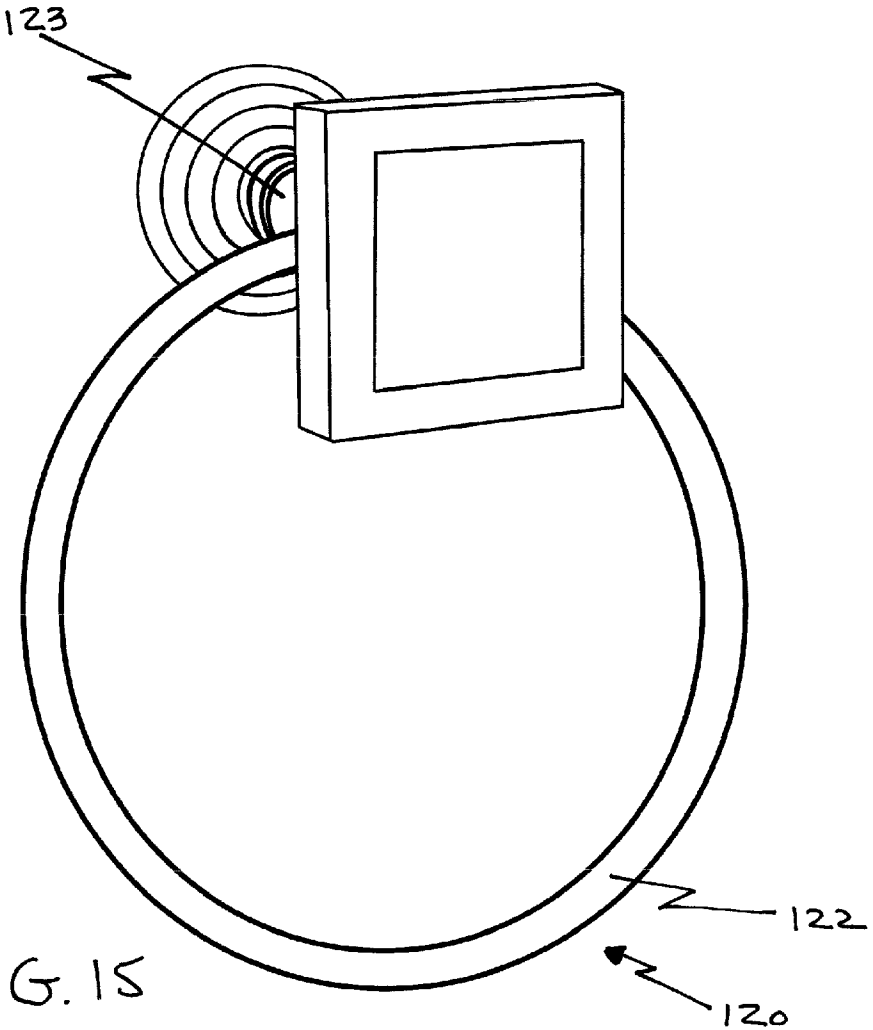
FIG. 15 is a front perspective view of an alternate embodiment of a tile holder, constructed in accordance with the present invention.
Figure 17:
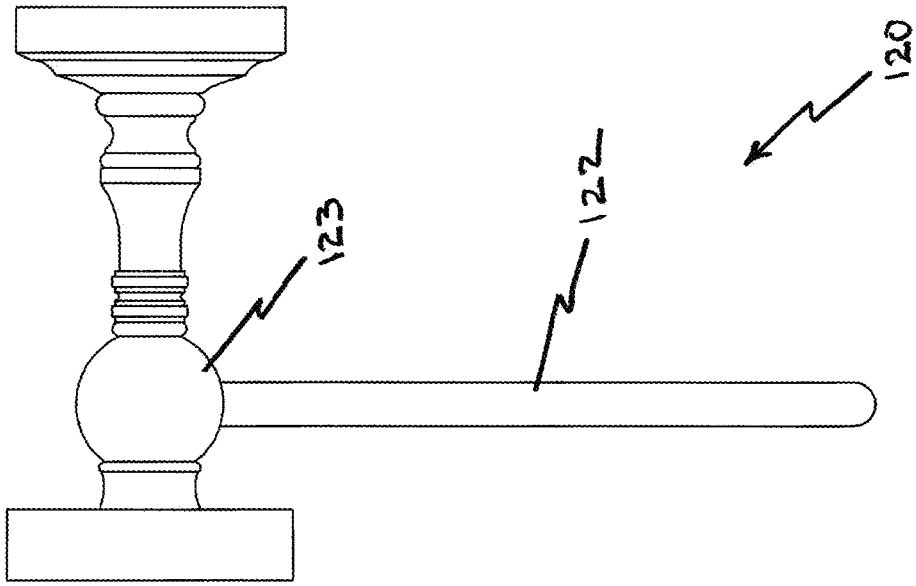
FIG. 17 is a side view of the alternate embodiment of the tile holder of FIG. 15.
Figure 16:
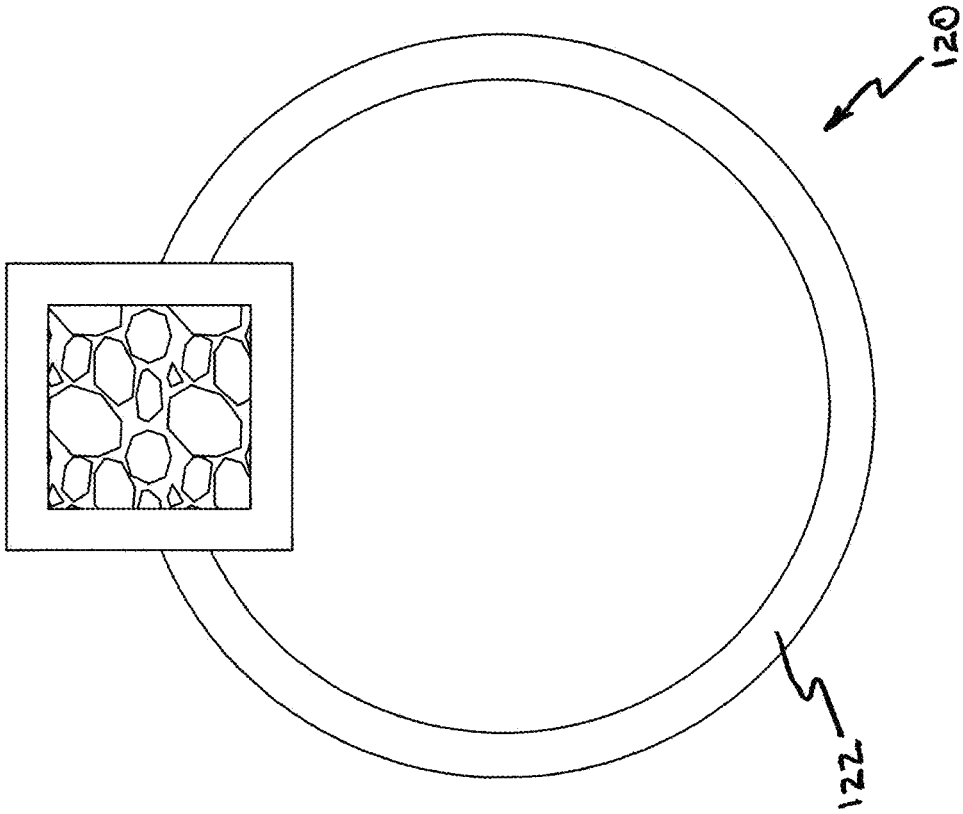
FIG. 16 is a front view of the alternate embodiment of the tile holder of FIG. 15.

FIGS. 15-17 show an alternate embodiment of a tile holder 120 of the present invention, which is substantially the same as the tile holder 10, except that the tile holder 120 has a ring 122 fastened to post 123 of the tile holder 100. The ring 122 may be used to hang towels or other suitable items therefrom.

Figure 18:
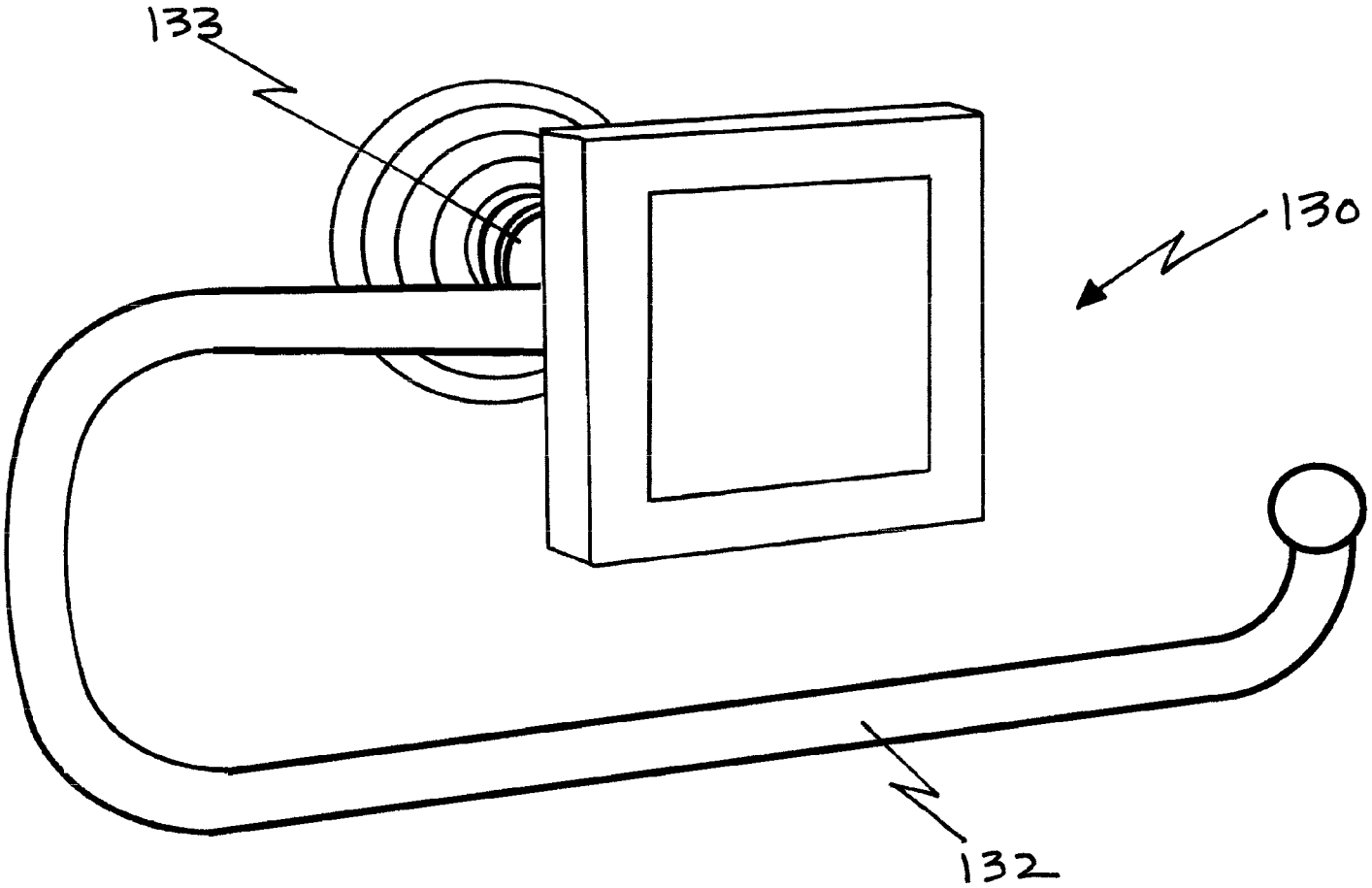
FIG. 18 is a front perspective view of an alternate embodiment of a tile holder, constructed in accordance with the present invention.
Figure 20:
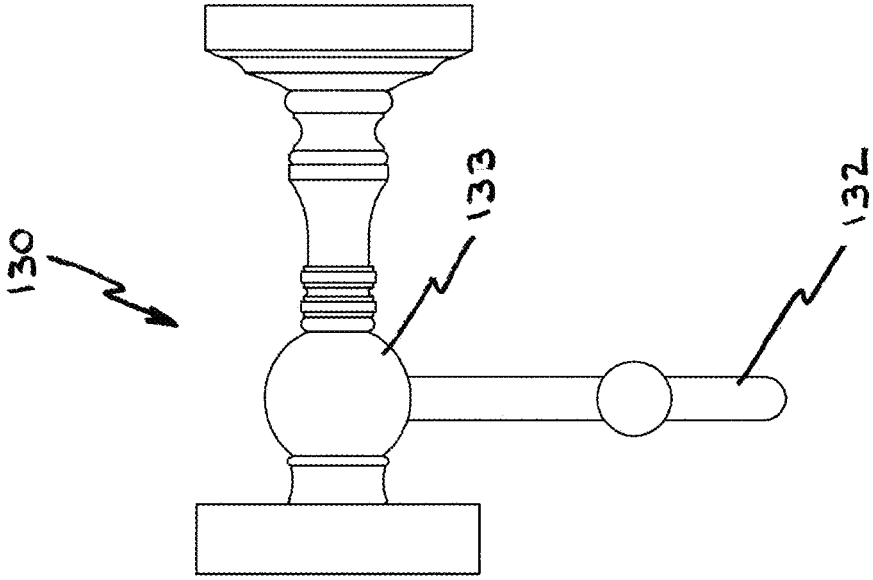
FIG. 20 is a side view of the alternate embodiment of the tile holder of FIG. 18.
Figure 19:
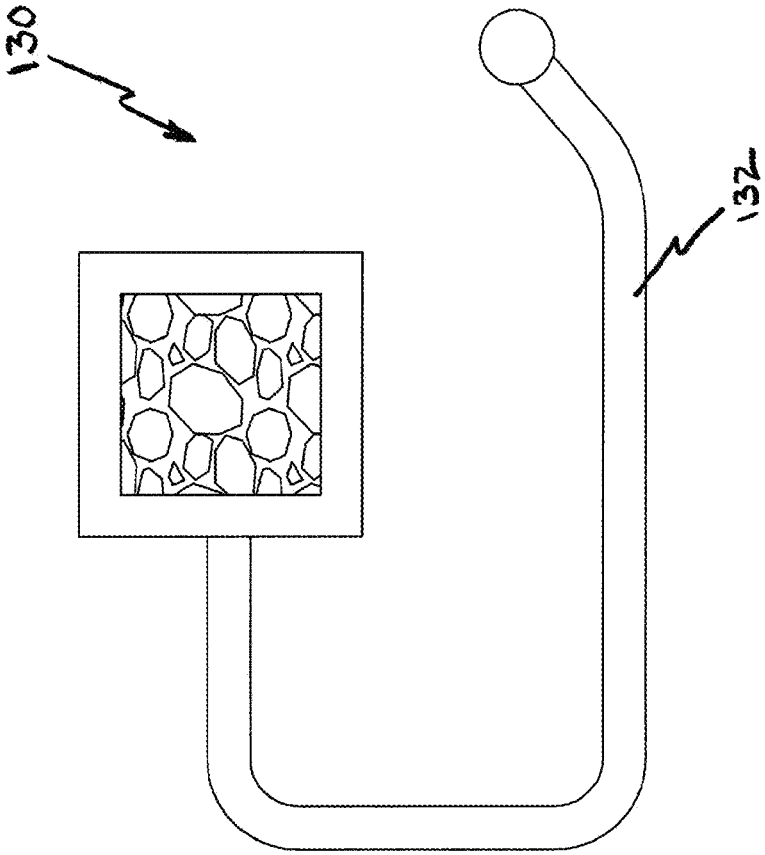
FIG. 19 is a front view of the alternate embodiment of the tile holder of FIG. 18.
Figure 21:
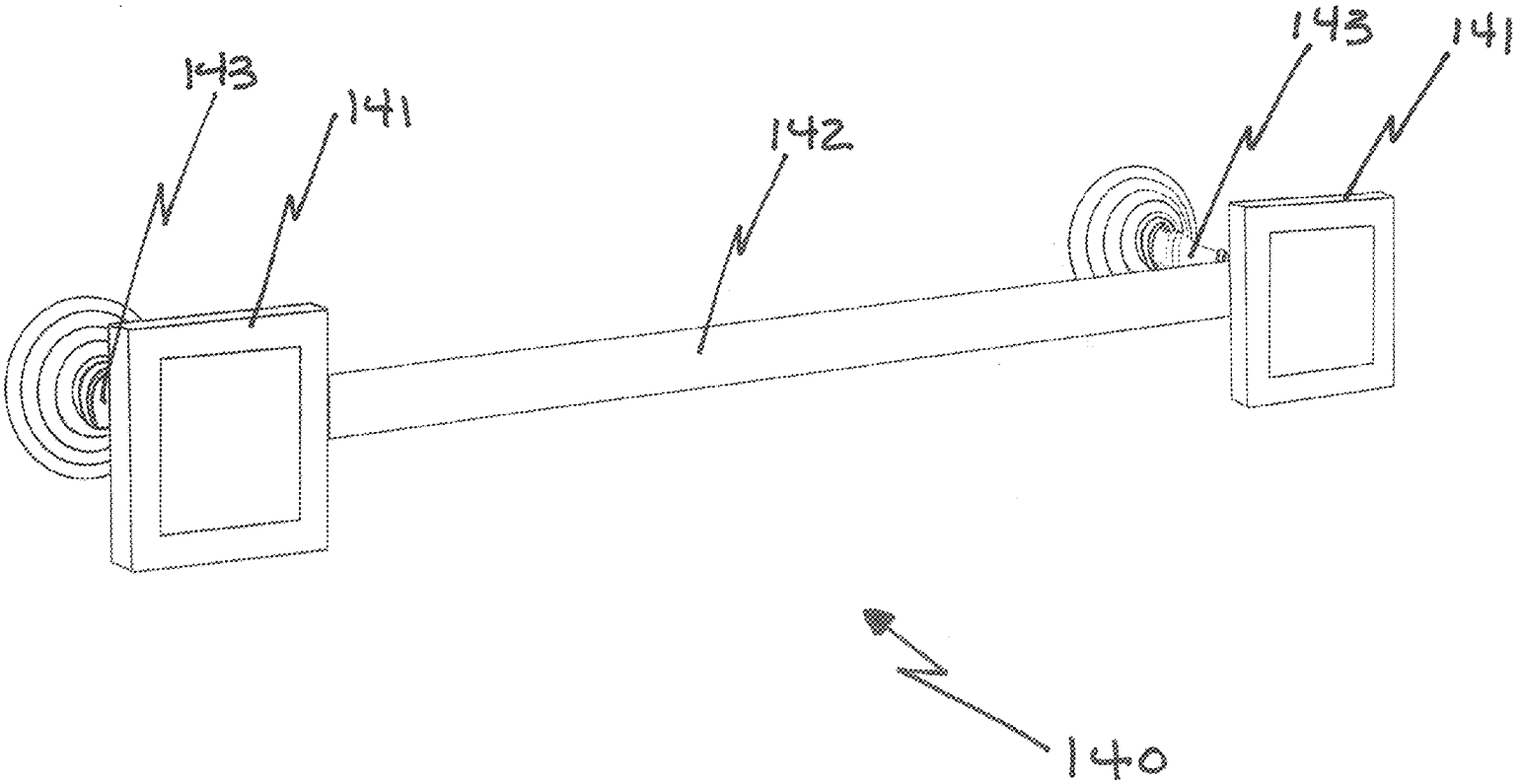
FIG. 21 is a front perspective view of an alternate embodiment of a tile holder, constructed in accordance with the present invention.
Figure 23:
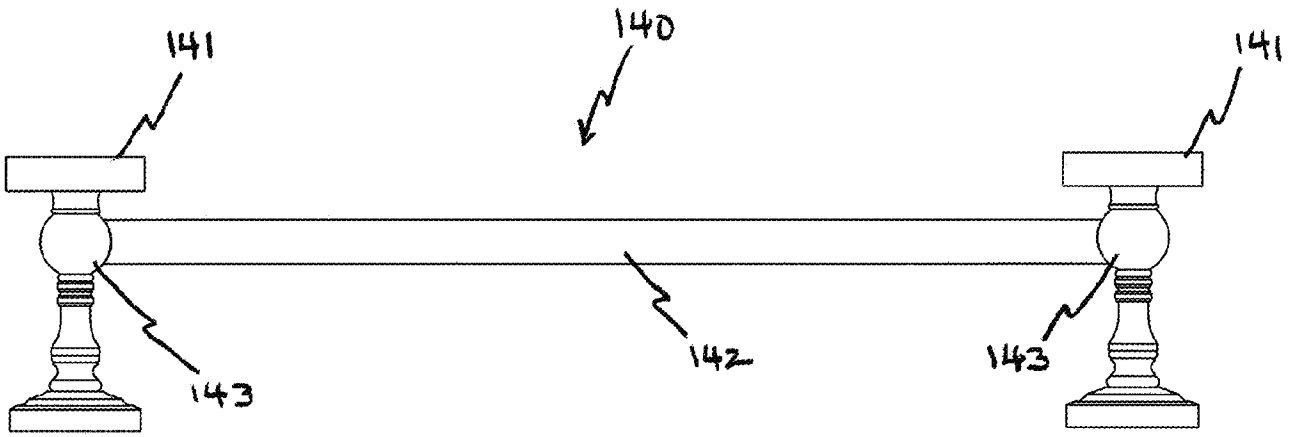
FIG. 23 is a side view of the alternate embodiment of the tile holder of FIG. 21.
Figure 22:
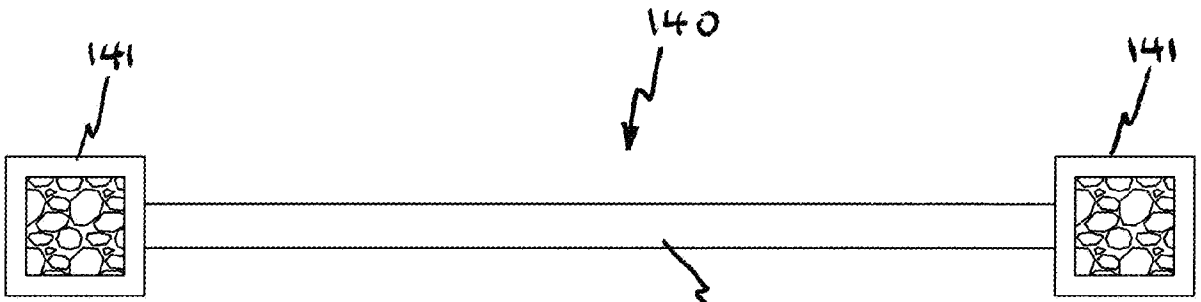
FIG. 22 is a front view of the alternate embodiment of the tile holder of FIG. 21.
Figure 24:
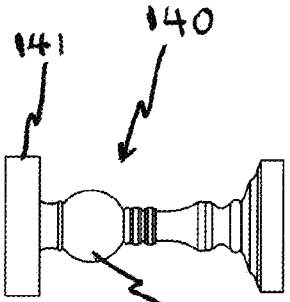
FIG. 24 is an end view of the alternate embodiment of the tile holder of FIG. 21.
Figure 25:
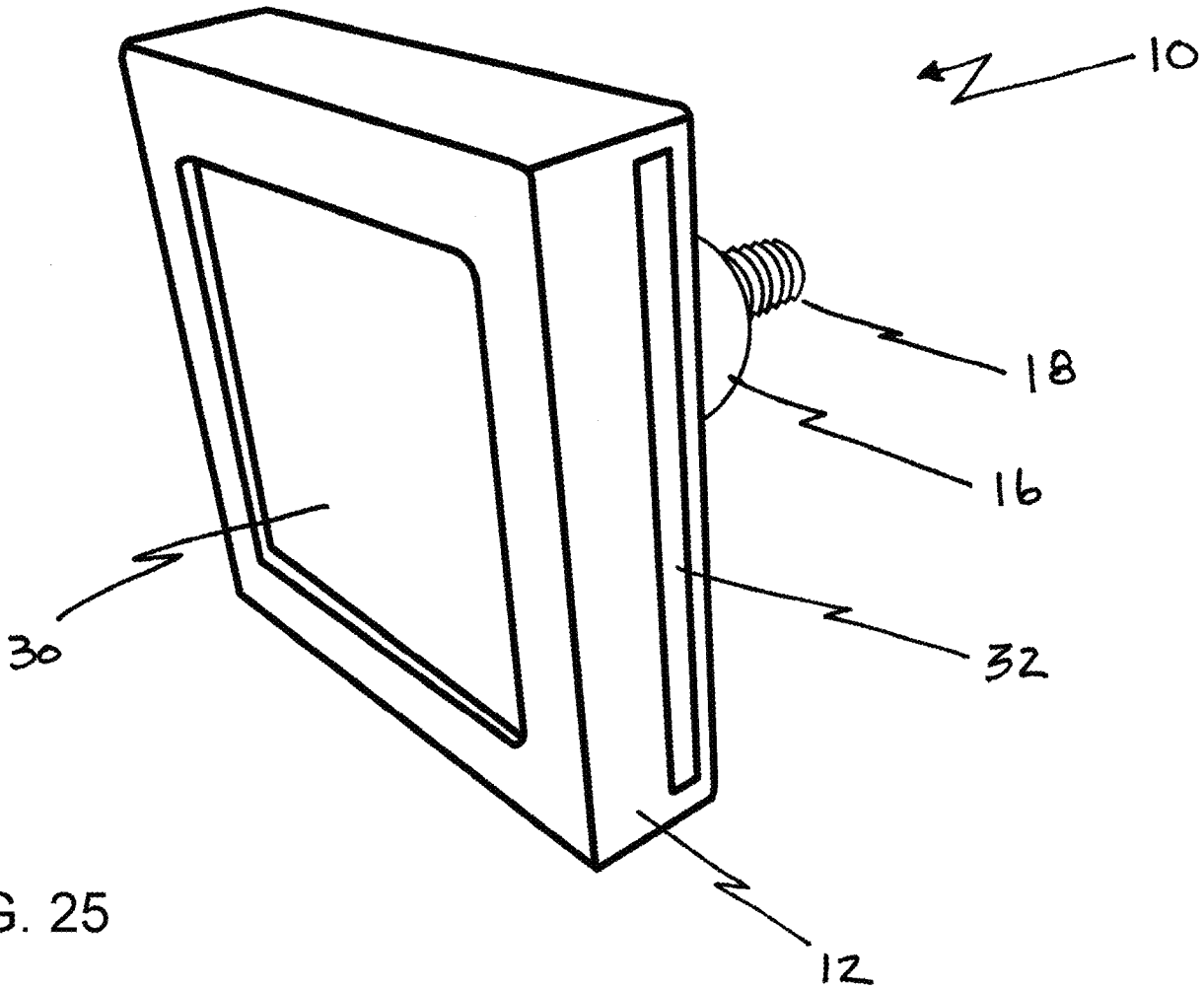
FIG. 25 is a front perspective view of a tile holder, constructed in accordance with the present invention.
Figure 26:
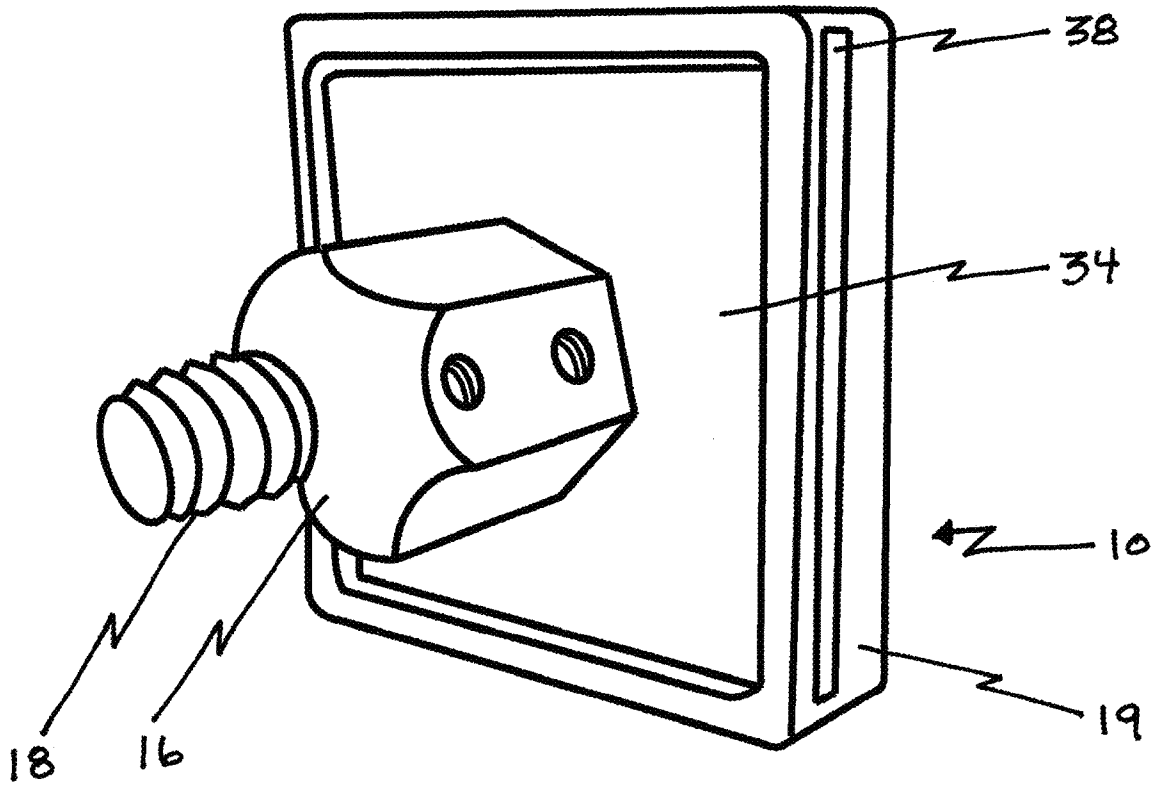
FIG. 26 is a rear perspective view of the tile holder of FIG. 25.
Figure 27:
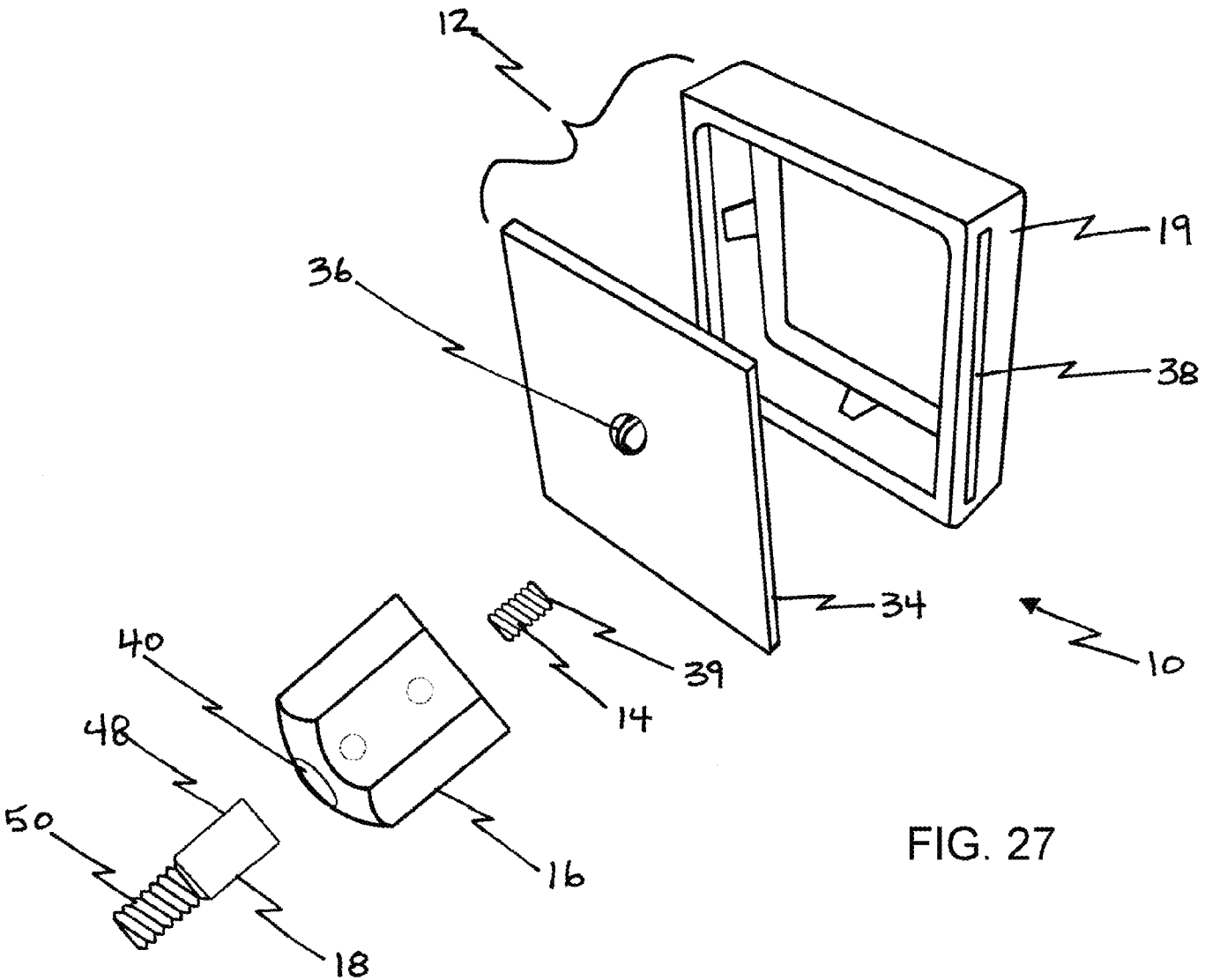
FIG. 27 is an exploded view of the tile holder of FIG. 25.
Figure 28:
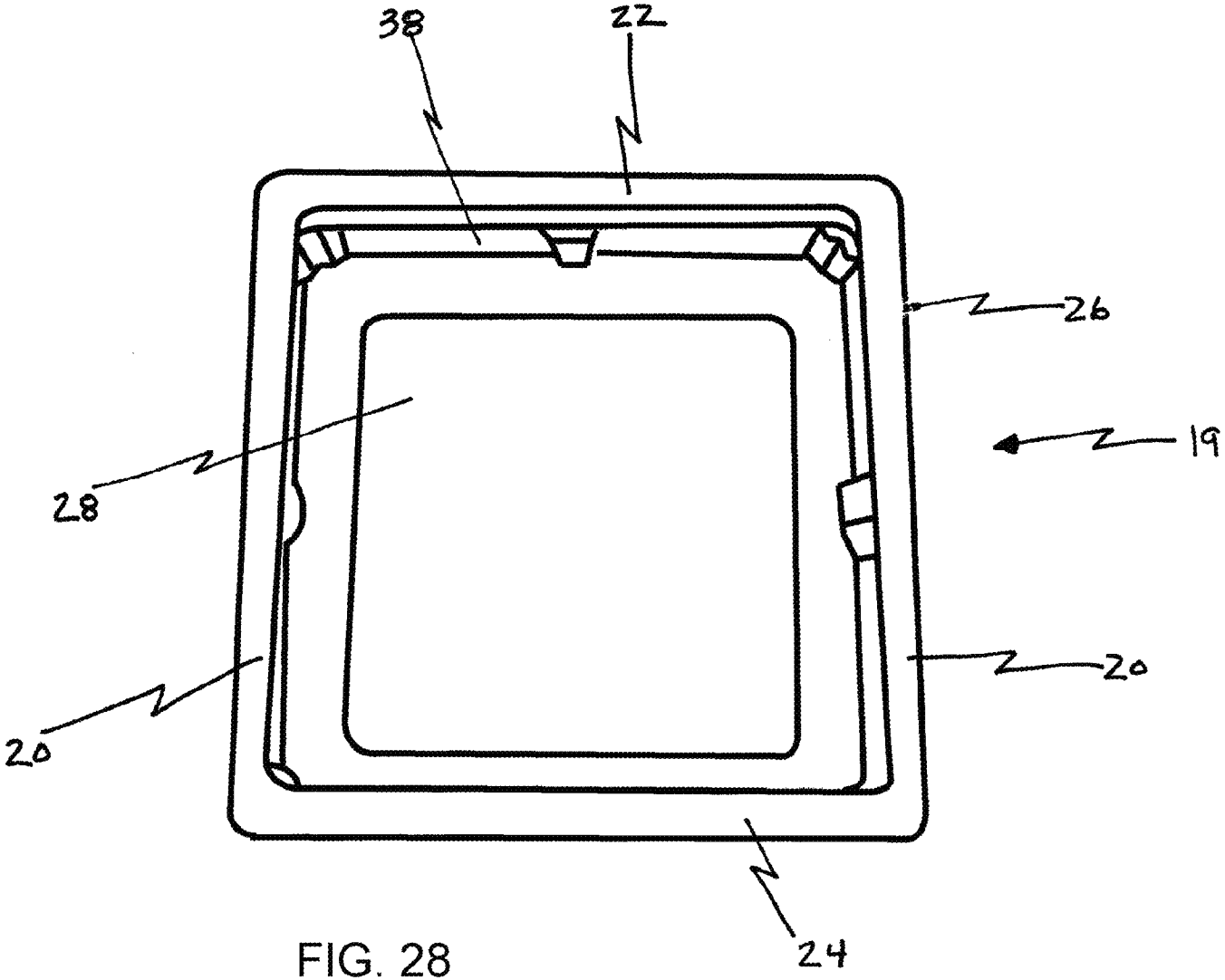
FIG. 28 is rear perspective view of a frame of the tile holder of FIG. 25.
Figure 29:
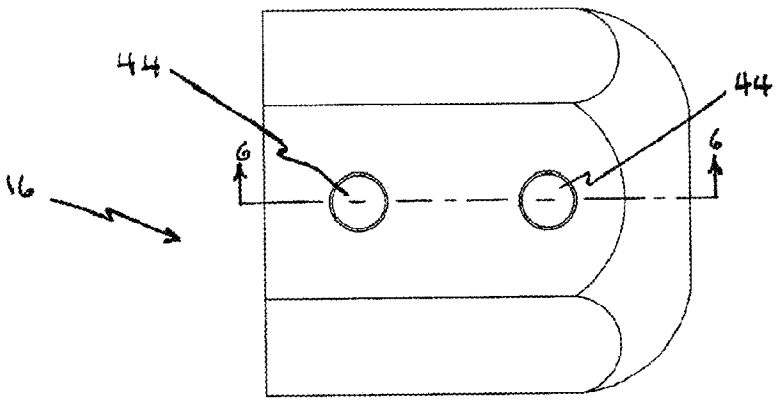
FIG. 29 is a side view of an intermediate fastener of the tile holder of FIG. 25.
Figure 30:
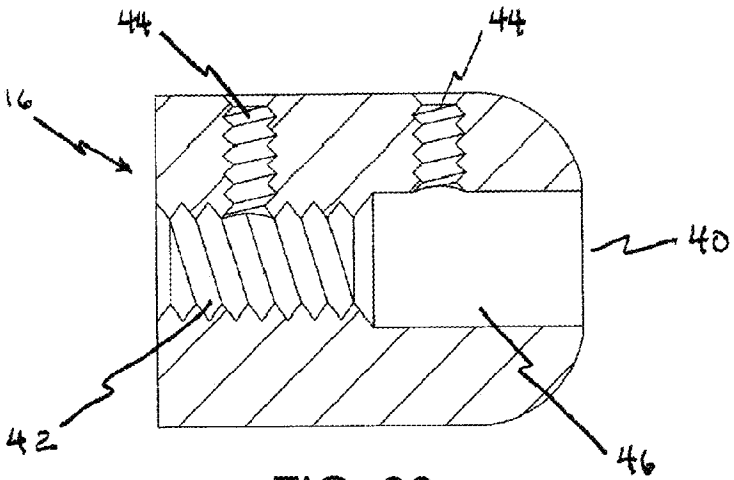
FIG. 30 is a section view of the intermediate fastener of FIG. 29.
Figure 31:
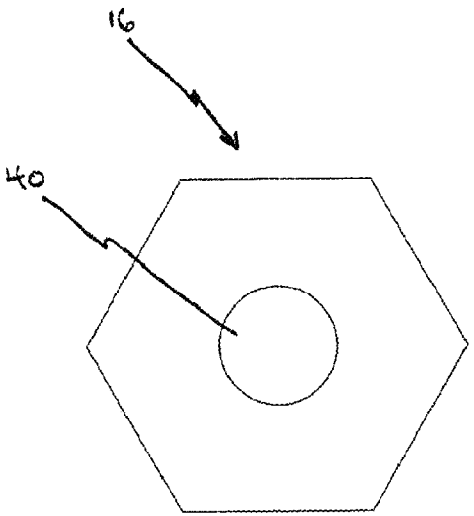
FIG. 31 is an end view of the intermediate fastener of FIG. 29.
Figure 32:
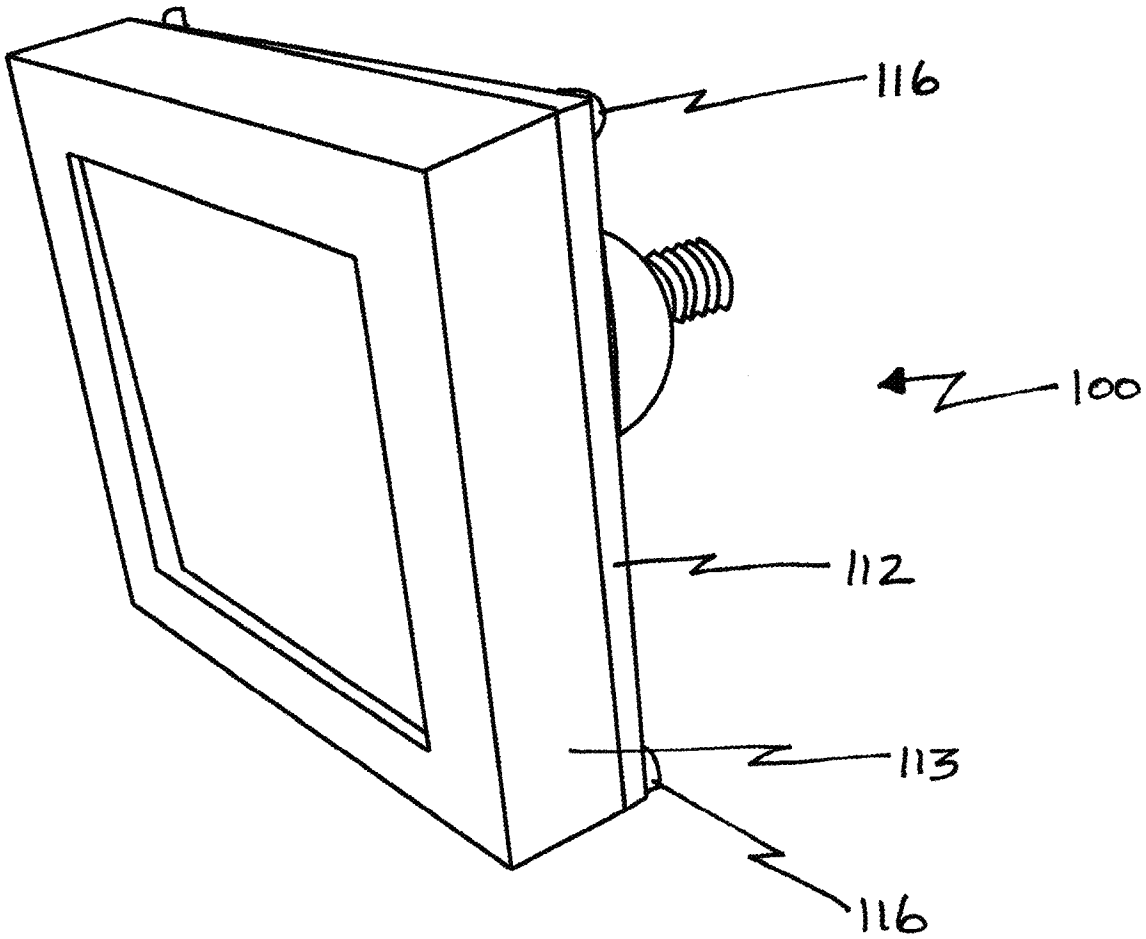
FIG. 32 is a front perspective view of an alternate embodiment of a tile holder, constructed in accordance with the present invention.
Figure 33:
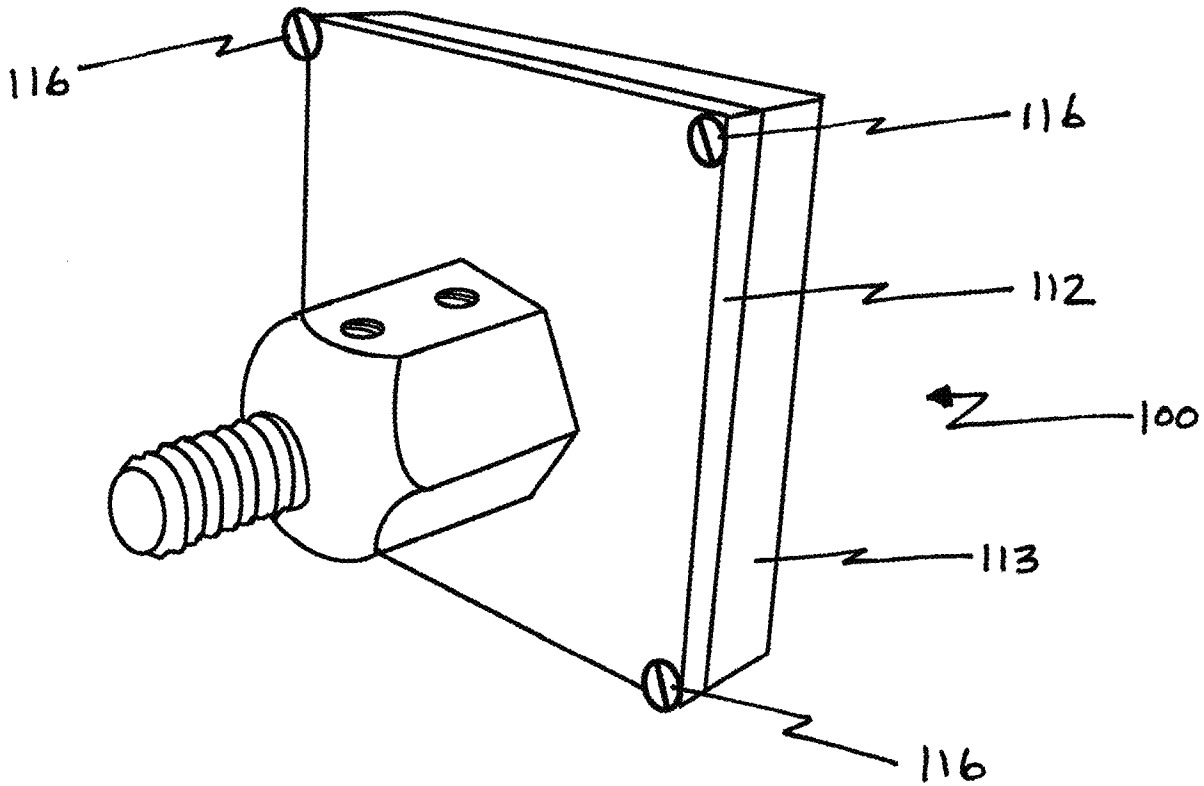
FIG. 33 is a rear perspective view of the tile holder of FIG. 32.
Figure 34:
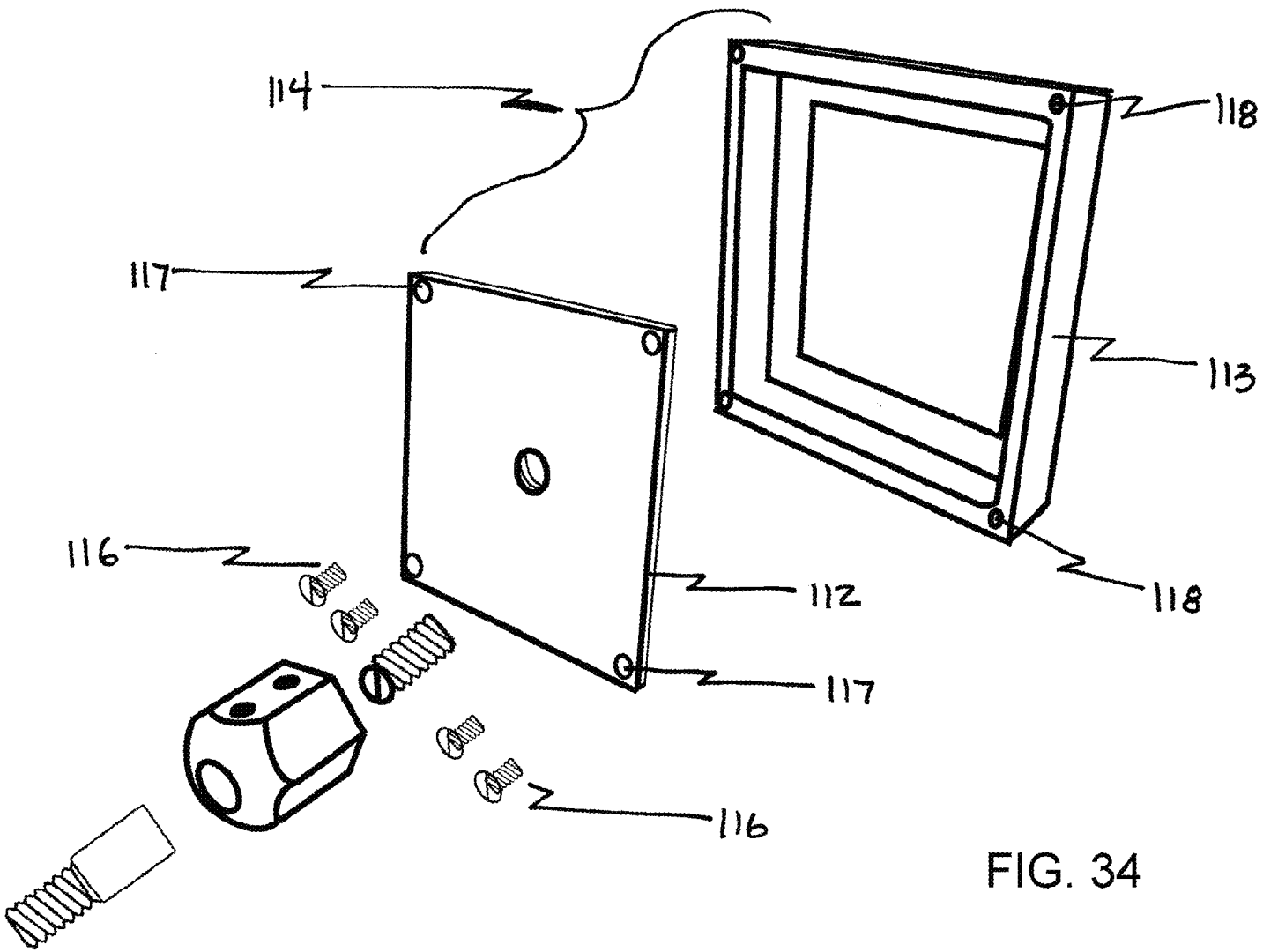
FIG. 34 is an exploded view of the tile holder of FIG. 32.
Figure 35:
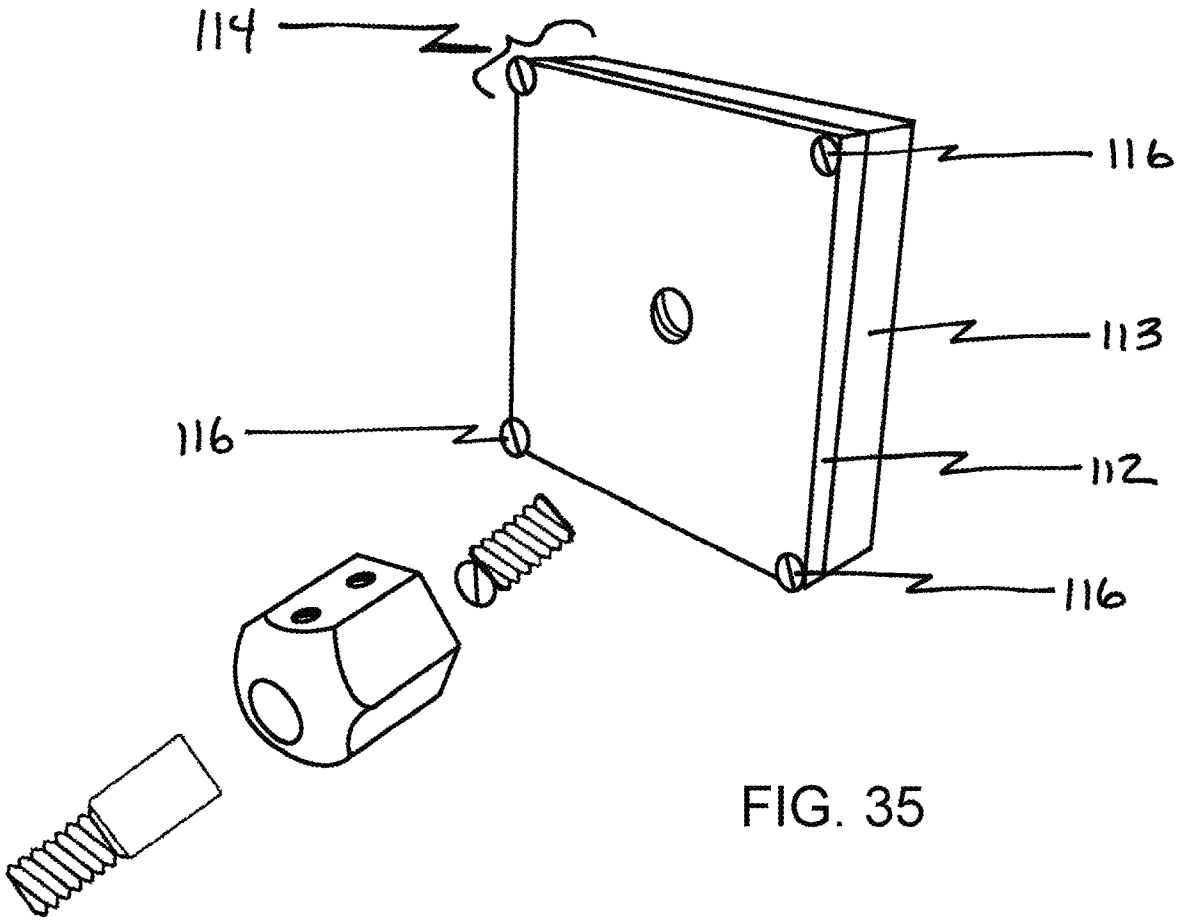
FIG. 35 is an exploded view of the tile holder of FIG. 32, showing a tile frame of the tile holder assembled.
Figure 36:
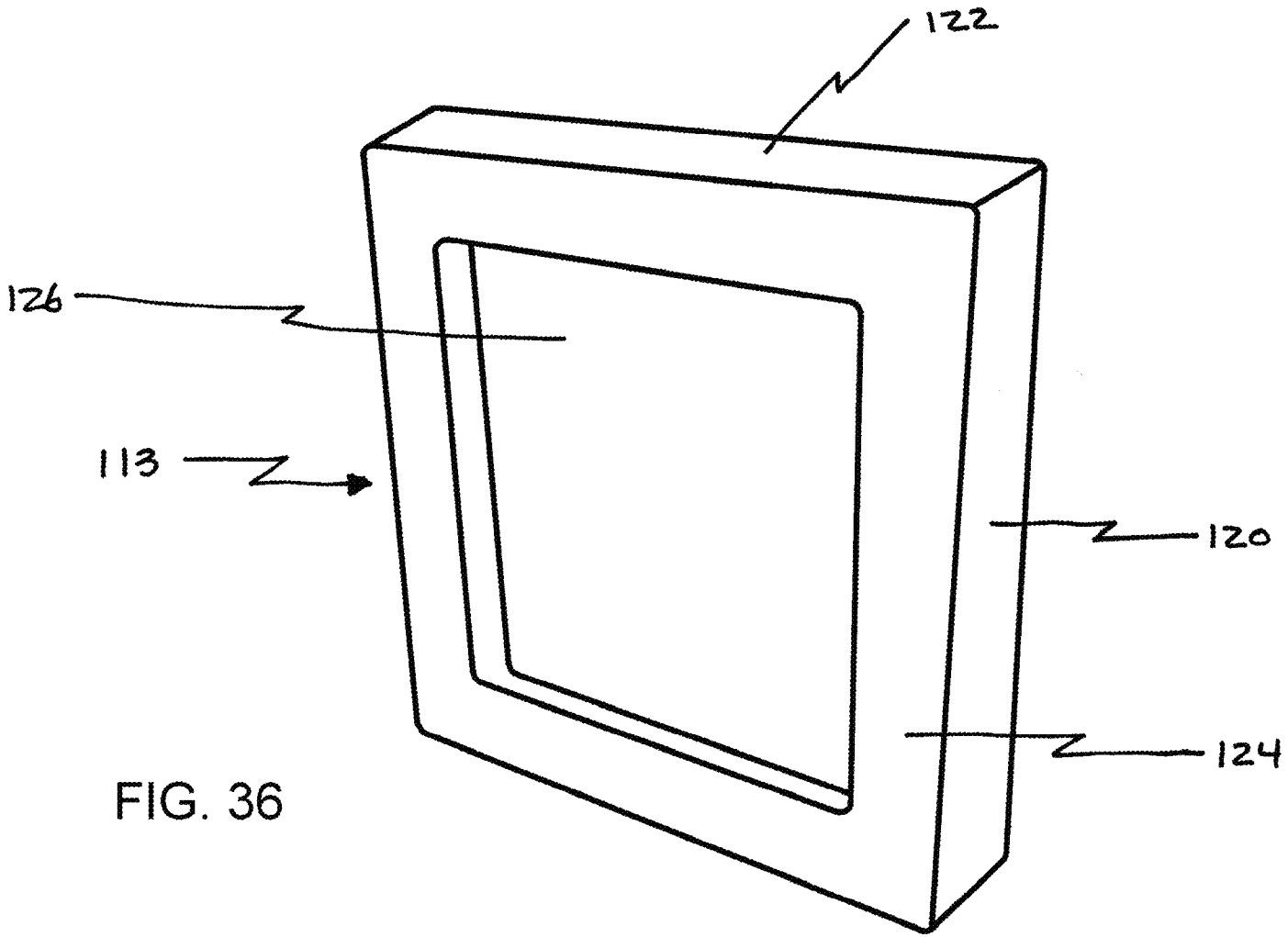
FIG. 36 is front perspective view of a frame of the tile holder of FIG. 32.
Figure 37:
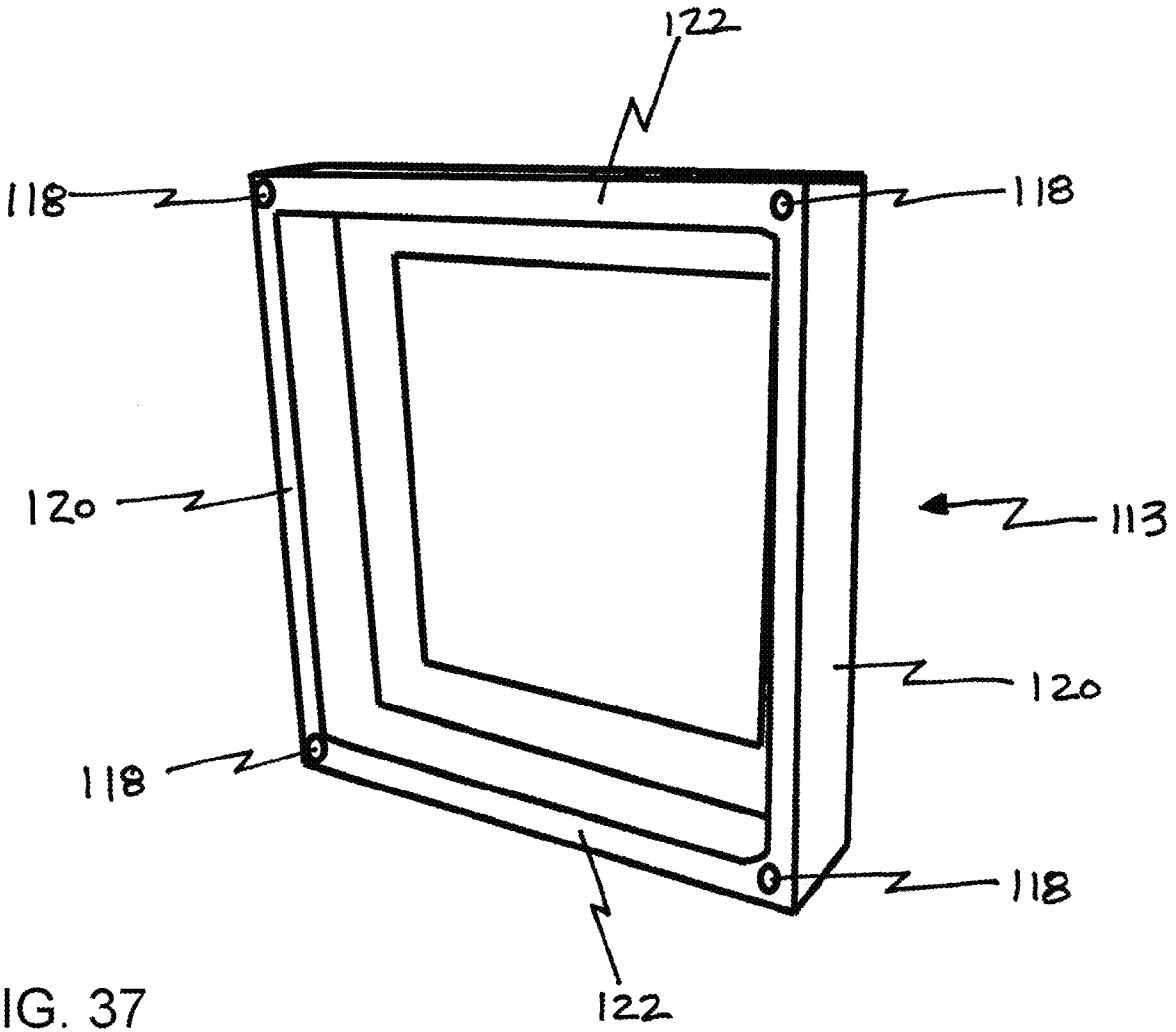
FIG. 37 is rear perspective view of the frame of FIG. 36.

FIGS. 18-20 show an alternate embodiment of a tile holder 130 of the present invention, which is substantially the same as the tile holder 10, except that the tile holder 130 has a paper roll holder 132 fastened to post 133 of the tile holder 130. The paper roll holder 132 may be used to hang toilet tissue rolls, paper towel rolls, or other suitable items therefrom.

FIGS. 21-24 show an alternate embodiment of a tile holder 140 of the present invention, which has opposing tile holders 141 and a rod 142 fastened to posts 143 of the opposing tile holders 141. The rod 142 may be used to hang towels or other suitable items therefrom.

FIGS. 25-31 show an embodiment of the present invention, a tile holder 10 for tiles and the like having a substantially cuboid or substantially rectangular parallelepiped shaped tile frame 12, tile frame rear fastener 14, intermediate fastener 16, and tile holder fastener 18.

The tile frame 12 comprises frame 19 having substantially parallel opposing sides 20, substantially parallel opposing sides 22 and 24, which are substantially perpendicular to the substantially parallel opposing sides 20, face plate 26 having aperture 28 for exposing face 30 of tile 32, and back plate 34 having threaded hole 36 for receiving tile frame rear fastener 14, which is also threaded.

The face plate 26 and the back plate 34, oppose one another and are substantially parallel to one another, each of which are substantially perpendicular to the substantially parallel opposing sides 26, and the substantially parallel opposing sides 22 and 24.

The opposing side 22 has slot 38 for receiving the tile 32 therethrough, and removably placing the tile 32 into the tile frame 12 or removing the tile 32 therefrom. The tile frame rear fastener 14 may be used to releasably fasten the tile 32 within the tile frame 12, by fastening the tile frame rear fastener 14, thus, applying pressure to the tile 32, and, thus, holding the tile 32 within the tile frame 12. The tile frame rear fastener 14 may be reversed, so that slot 39 of the tile frame rear fastener 14 faces toward the tile holder fastener 18.

The tile frame rear fastener 32 may be used to releasably fasten the tile 26 within the tile frame 12 by fastening the tile frame rear fastener 32, thus, applying pressure to the optional spacer 36 and/or the tile 26 and holding the tile 26 within the tile frame 12. The intermediate fastener 16 has substantially cylindrical hole 40 therethrough, which has threaded portion 42 for receiving the tile frame rear fastener 14 and fastening the intermediate fastener 16 to the tile frame 12, and substantially cylindrical portion 46 for receiving the tile holder fastener 18. The intermediate fastener 16 also has threaded holes 44 for receiving set screws.

The tile holder fastener 18 has substantially cylindrical portion 48 for insertion into the intermediate fastener 16 and threaded portion 50 for fastening the tile holder 10 to a suitable object. The set screws are used to further tighten the intermediate fastener 16 and the tile frame rear fastener 14 one to the other and to fasten the tile holder fastener to the intermediate fastener 16 one to the other. The tile holder fastener 18 is adapted to fasten the tile holder 10 to walls, surfaces, and suitable objects.

FIGS. 32-37 show an alternate embodiment of a tile holder 100 of the present invention, which is substantially the same as the tile holder 10, except that the tile holder 100 has back plate 112, which is removably fastened to frame 113 of tile frame 114 with threaded fasteners 116, the back plate 112 having holes 117 for receiving the threaded fasteners 116 therethrough, and the frame 113 having threaded holes 118 for receiving the threaded fasteners 116.

The frame 113 also has substantially parallel opposing sides 120 and substantially parallel opposing sides 122, which are substantially perpendicular to the substantially parallel opposing sides 120, and face plate 124 having aperture 126, the face plate 124 substantially parallel to and opposing the back plate 112.

The tile 32 may be removably replaced from the tile holder 100 by removing the threaded fasteners 116 and the back plate 112 from the frame 113, removing the tile 32 therefrom, replacing the tile 32 with an alternate tile, and fastening the back plate 112 to the frame 113.

Alternate tile holders may be constructed in accordance with the present invention that have square, rectangular, diamond, triangular, circular, elliptical, or other suitable shaped tile frames and/or that receive square, rectangular, diamond, triangular, circular, elliptical, or other suitable shaped tiles. The tiles, decorative tiles, and the like may be decorative tiles and optionally may have indicia and/or names of individuals, animals, pets, or suitable objects.

Although the present invention has been described in considerable detail with reference to embodiments or versions thereof, other versions are possible. Therefore, the spirit and scope of the appended claims should not be limited to the description of the versions contained herein.

I claim:

1. A tile holder consisting of:

a tile frame including a face plate, a receptacle, and an aperture;

a back plate, the back plate and the face plate being substantially parallel to each other and the back plate being removably fastened to the tile frame by threaded fasteners extending through the back plate and into threaded holes disposed on the tile frame;

a cylindrical stud projecting from the back plate and including a threaded interior and a non-threaded exterior surface;

a rear threaded fastener residing within the cylindrical stud threaded interior;

a post fastened to the back plate and extending substantially perpendicular therefrom, the post including a receiving hole within which resides a portion of the cylindrical stud;

a decorative tile residing in the receptacle, a face of the decorative tile being viewable through the aperture wherein the tile holder is installed on a wall with the post coupled to the wall.

2. The tile holder of claim 1, wherein the rear threaded fastener extends through the back plate and presses against the decorative tile to hold the decorative tile in place within the tile frame.

3. A tile holder consisting of:

a tile frame including a face plate, a receptacle, and an aperture;

a back plate, the back plate and the face plate being substantially parallel to each other and the back plate being removably fastened to the tile frame by threaded fasteners extending through the back plate and into threaded holes disposed on the tile frame;

a cylindrical stud projecting from the back plate and including a threaded interior and a non-threaded exterior surface;

a rear threaded fastener residing within the cylindrical stud threaded interior;

a post fastened to the back plate and extending substantially perpendicular therefrom, the post including (i) a receiving hole within which resides a portion of the cylindrical stud, and (ii) a set screw holding the cylindrical stud within the receiving hole;

a decorative tile residing in the receptacle, a face of the decorative tile being viewable through the aperture; and a spacer residing between the back plate and the decorative tile and being substantially parallel thereto wherein the tile holder is installed on a wall with the post coupled to the wall.

4. The tile holder of claim 3, wherein the rear threaded fastener extends through the back plate and presses against the spacer to hold the decorative tile in place within the tile frame.

* * * * *